US008967752B2

(12) United States Patent
Oguchi et al.

(10) Patent No.: US 8,967,752 B2
(45) Date of Patent: Mar. 3, 2015

(54) INKJET RECORDING APPARATUS

(75) Inventors: Tomoya Oguchi, Aichi-ken (JP); Yusuke Arai, Aichi-ken (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 215 days.

(21) Appl. No.: 13/337,591

(22) Filed: Dec. 27, 2011

(65) Prior Publication Data

US 2012/0162302 A1 Jun. 28, 2012

(30) Foreign Application Priority Data

Dec. 28, 2010 (JP) ..... 2010-293965

(51) Int. Cl.

| | |
|---|---|
| ***B41J 29/38*** | (2006.01) |
| ***B41J 2/175*** | (2006.01) |
| ***B41J 3/407*** | (2006.01) |
| ***B41J 13/10*** | (2006.01) |
| ***B41J 29/13*** | (2006.01) |

(52) U.S. Cl.

CPC ..... *B41J 2/175* (2013.01); *B41J 2/17509* (2013.01); *B41J 3/4073* (2013.01); *B41J 13/103* (2013.01); *B41J 29/13* (2013.01); *B41J 29/38* (2013.01)

USPC ..... 347/16; 347/5; 347/101; 347/104

(58) Field of Classification Search

CPC ..... B41J 29/38

See application file for complete search history.

(56) References Cited

U.S. PATENT DOCUMENTS

| | | | | |
|---|---|---|---|---|
| 6,328,394 | B1 * | 12/2001 | Shirai et al. | 347/2 |
| 7,137,698 | B2 | 11/2006 | Miyake et al. | |
| 7,533,985 | B2 | 5/2009 | Miyake et al. | |
| 7,547,099 | B2 | 6/2009 | Miyake et al. | |
| 7,641,331 | B2 * | 1/2010 | Chen | 347/104 |
| 7,645,013 | B2 * | 1/2010 | Murakami et al. | 347/19 |
| 8,070,284 | B2 * | 12/2011 | Miyashita et al. | 347/104 |
| 2005/0093953 | A1 | 5/2005 | Miyake et al. | |
| 2006/0181566 | A1 * | 8/2006 | Miyashita et al. | 347/20 |
| 2007/0048058 | A1 | 3/2007 | Koga et al. | |
| 2007/0048059 | A1 | 3/2007 | Asada et al. | |
| 2007/0057447 | A1 | 3/2007 | Asada et al. | |

(Continued)

FOREIGN PATENT DOCUMENTS

| | | | |
|---|---|---|---|
| JP | 2005-247584 | A | 9/2005 |
| JP | 2007-090761 | A | 4/2007 |

(Continued)

*Primary Examiner* — Manish S Shah

*Assistant Examiner* — Jeremy Delozier

(74) *Attorney, Agent, or Firm* — Scully, Scott, Murphy & Presser, P.C.

(57) ABSTRACT

An inkjet recording device includes a tray receives a recording medium. A tray guide is movable between a first position and a second position. A first sensor outputs a first signal indicative of the position of the tray guide. A recording portion records an image on the recording medium. A cleaning mechanism cleans the recording portion. A first conveyor portion conveys the tray. A first drive source rotates in a forward direction of rotation and a reverse direction of rotation. A power transmitting portion transmits a force generated by the first drive source to both the cleaning mechanism and the first conveyor portion. A control section drives the first drive source in the forward direction of rotation using a first predetermined amount if the control section determined that the first sensor has detected that the tray guide is not in the second position under the cleaning operation.

14 Claims, 13 Drawing Sheets

(56) References Cited

U.S. PATENT DOCUMENTS

| | | | | |
|---|---|---|---|---|
| 2007/0058024 | A1 | 3/2007 | Miyake et al. | |
| 2007/0058025 | A1 | 3/2007 | Miyake et al. | |
| 2007/0058026 | A1 | 3/2007 | Miyake et al. | |
| 2007/0231044 | A1 | 10/2007 | Koga et al. | |
| 2008/0049062 | A1* | 2/2008 | Igarashi | 347/16 |
| 2009/0214228 | A1* | 8/2009 | Ito | 399/21 |
| 2009/0278905 | A1* | 11/2009 | Onuma et al. | 347/104 |
| 2011/0069102 | A1* | 3/2011 | Horade et al. | 347/16 |

FOREIGN PATENT DOCUMENTS

| | | | |
|---|---|---|---|
| JP | 2007-237426 | A | 9/2007 |
| JP | 9-295412 | A | 11/2007 |

* cited by examiner

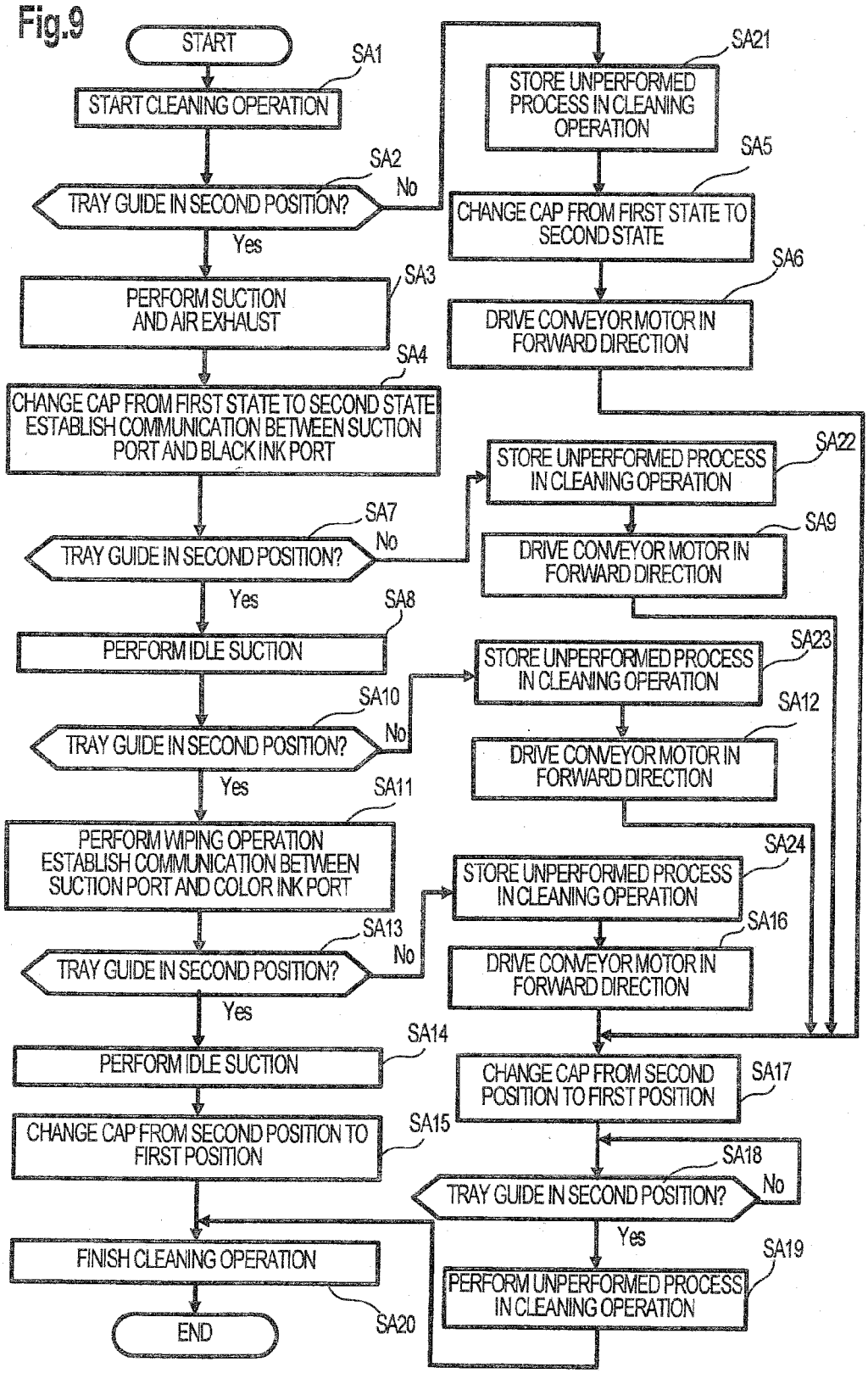
Fig.9
START
SA1
START CLEANING OPERATION
SA2
TRAY GUIDE IN SECOND POSITION?
No
Yes
SA3
PERFORM SUCTION AND AIR EXHAUST
SA4
CHANGE CAP FROM FIRST STATE TO SECOND STATE ESTABLISH COMMUNICATION BETWEEN SUCTION PORT AND BLACK INK PORT
SA7
TRAY GUIDE IN SECOND POSITION?
No
Yes
SA8
PERFORM IDLE SUCTION
SA10
TRAY GUIDE IN SECOND POSITION?
No
Yes
SA11
PERFORM WIPING OPERATION ESTABLISH COMMUNICATION BETWEEN SUCTION PORT AND COLOR INK PORT
SA13
TRAY GUIDE IN SECOND POSITION?
No
Yes
SA14
PERFORM IDLE SUCTION
SA15
CHANGE CAP FROM SECOND POSITION TO FIRST POSITION
FINISH CLEANING OPERATION
SA20
END
SA21
STORE UNPERFORMED PROCESS IN CLEANING OPERATION
SA5
CHANGE CAP FROM FIRST STATE TO SECOND STATE
SA6
DRIVE CONVEYOR MOTOR IN FORWARD DIRECTION
SA22
STORE UNPERFORMED PROCESS IN CLEANING OPERATION
SA9
DRIVE CONVEYOR MOTOR IN FORWARD DIRECTION
SA23
STORE UNPERFORMED PROCESS IN CLEANING OPERATION
SA12
DRIVE CONVEYOR MOTOR IN FORWARD DIRECTION
SA24
STORE UNPERFORMED PROCESS IN CLEANING OPERATION
SA16
DRIVE CONVEYOR MOTOR IN FORWARD DIRECTION
SA17
CHANGE CAP FROM SECOND POSITION TO FIRST POSITION
SA18
TRAY GUIDE IN SECOND POSITION?
No
Yes
SA19
PERFORM UNPERFORMED PROCESS IN CLEANING OPERATION

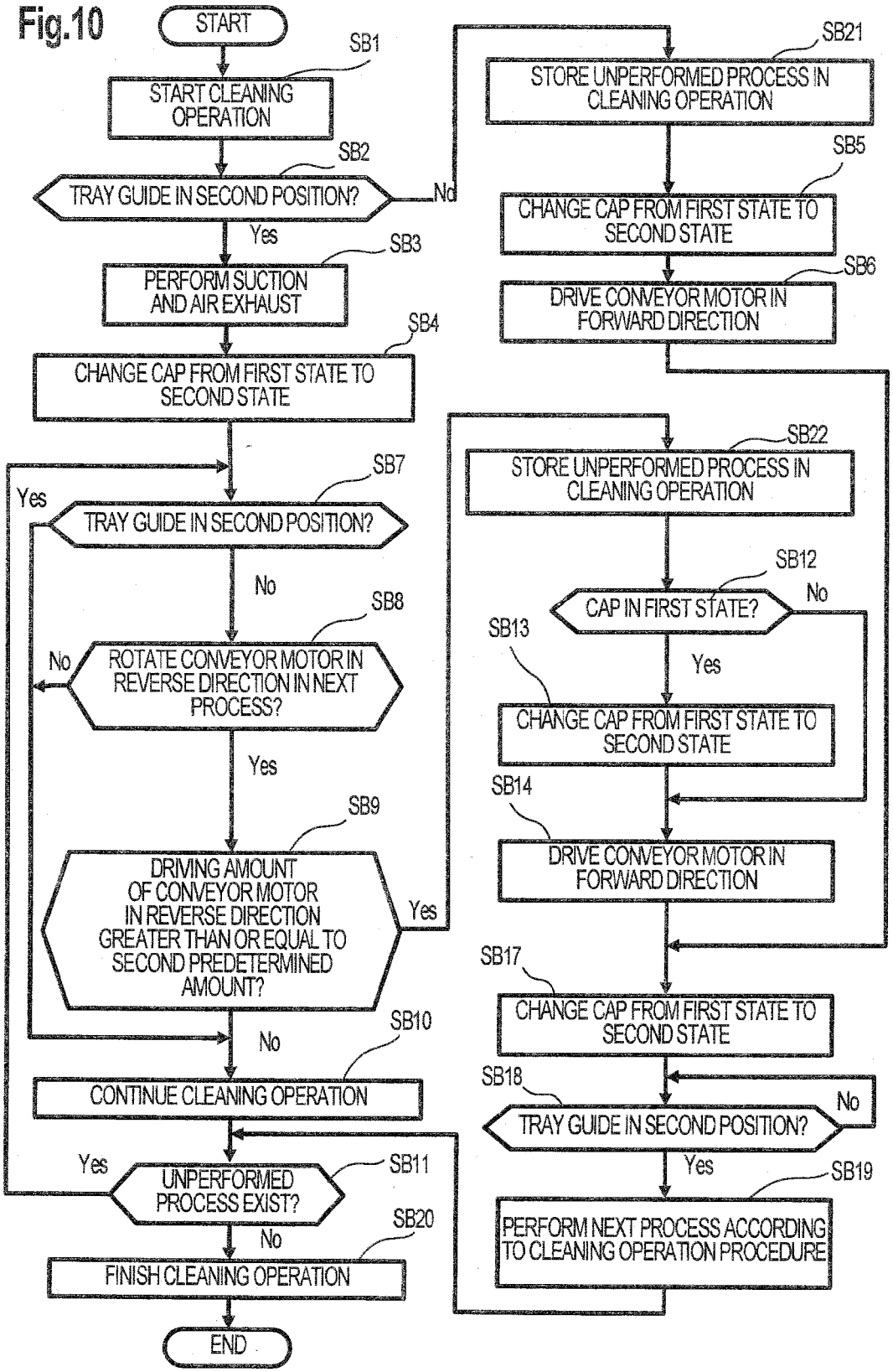
Fig.10
START
SB1
START CLEANING OPERATION
SB2
TRAY GUIDE IN SECOND POSITION?
No
Yes
SB3
PERFORM SUCTION AND AIR EXHAUST
SB4
CHANGE CAP FROM FIRST STATE TO SECOND STATE
SB7
Yes
TRAY GUIDE IN SECOND POSITION?
No
SB8
No
ROTATE CONVEYOR MOTOR IN REVERSE DIRECTION IN NEXT PROCESS?
Yes
SB9
DRIVING AMOUNT OF CONVEYOR MOTOR IN REVERSE DIRECTION GREATER THAN OR EQUAL TO SECOND PREDETERMINED AMOUNT?
Yes
No
SB10
CONTINUE CLEANING OPERATION
Yes
SB11
UNPERFORMED PROCESS EXIST?
No
SB20
FINISH CLEANING OPERATION
END
SB21
STORE UNPERFORMED PROCESS IN CLEANING OPERATION
SB5
CHANGE CAP FROM FIRST STATE TO SECOND STATE
SB6
DRIVE CONVEYOR MOTOR IN FORWARD DIRECTION
SB22
STORE UNPERFORMED PROCESS IN CLEANING OPERATION
SB12
CAP IN FIRST STATE?
No
Yes
SB13
CHANGE CAP FROM FIRST STATE TO SECOND STATE
SB14
DRIVE CONVEYOR MOTOR IN FORWARD DIRECTION
SB17
CHANGE CAP FROM FIRST STATE TO SECOND STATE
SB18
TRAY GUIDE IN SECOND POSITION?
No
Yes
SB19
PERFORM NEXT PROCESS ACCORDING TO CLEANING OPERATION PROCEDURE

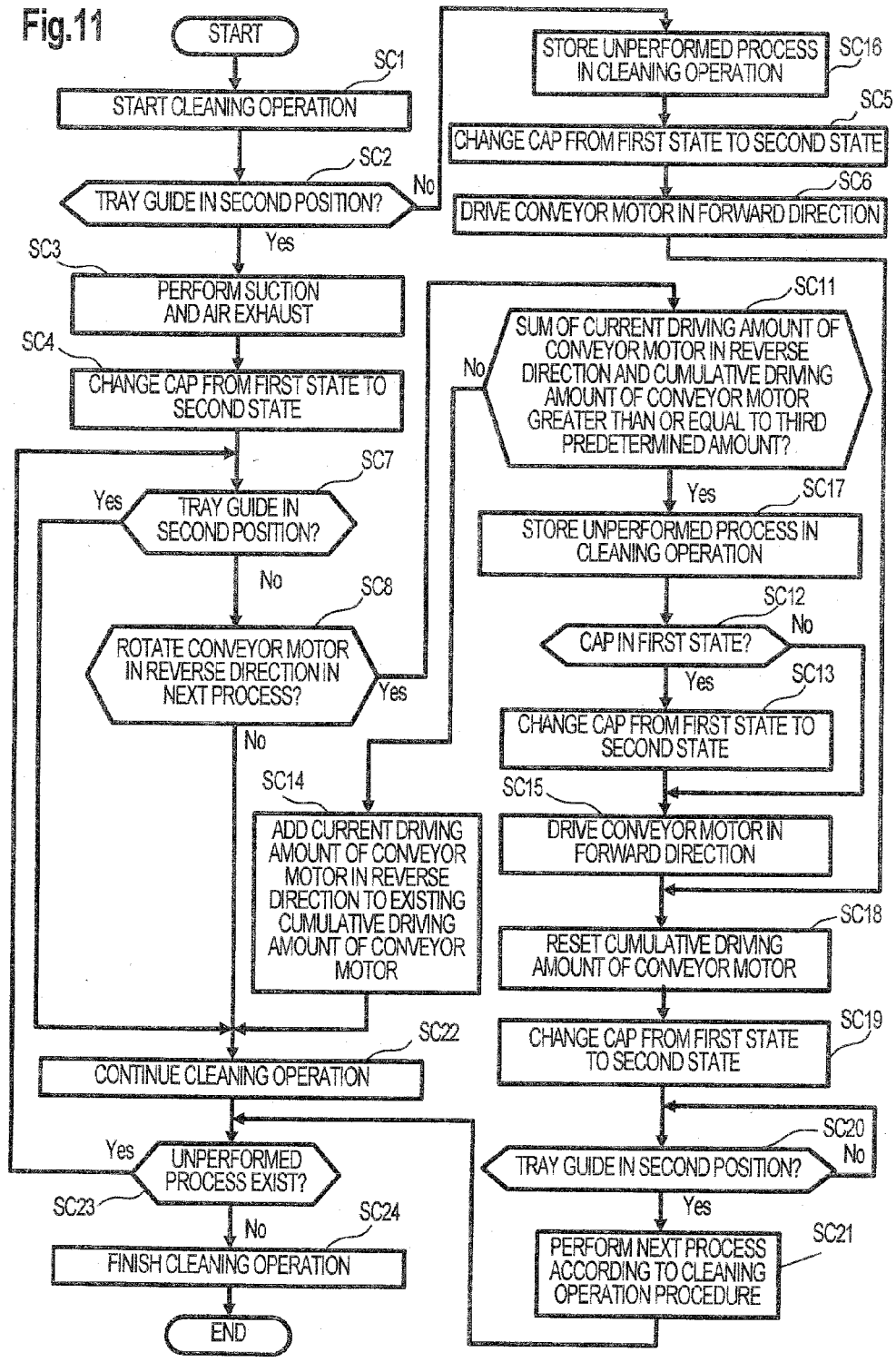
Fig.11
START
SC1
START CLEANING OPERATION
SC2
TRAY GUIDE IN SECOND POSITION?
No
Yes
SC3
PERFORM SUCTION AND AIR EXHAUST
SC4
CHANGE CAP FROM FIRST STATE TO SECOND STATE
SC7
TRAY GUIDE IN SECOND POSITION?
Yes
No
SC8
ROTATE CONVEYOR MOTOR IN REVERSE DIRECTION IN NEXT PROCESS?
Yes
No
SC14
ADD CURRENT DRIVING AMOUNT OF CONVEYOR MOTOR IN REVERSE DIRECTION TO EXISTING CUMULATIVE DRIVING AMOUNT OF CONVEYOR MOTOR
SC22
CONTINUE CLEANING OPERATION
Yes
UNPERFORMED PROCESS EXIST?
SC23
No
SC24
FINISH CLEANING OPERATION
END
SC16
STORE UNPERFORMED PROCESS IN CLEANING OPERATION
SC5
CHANGE CAP FROM FIRST STATE TO SECOND STATE
SC6
DRIVE CONVEYOR MOTOR IN FORWARD DIRECTION
SC11
SUM OF CURRENT DRIVING AMOUNT OF CONVEYOR MOTOR IN REVERSE DIRECTION AND CUMULATIVE DRIVING AMOUNT OF CONVEYOR MOTOR GREATER THAN OR EQUAL TO THIRD PREDETERMINED AMOUNT?
No
Yes
SC17
STORE UNPERFORMED PROCESS IN CLEANING OPERATION
SC12
CAP IN FIRST STATE?
No
Yes
SC13
CHANGE CAP FROM FIRST STATE TO SECOND STATE
SC15
DRIVE CONVEYOR MOTOR IN FORWARD DIRECTION
SC18
RESET CUMULATIVE DRIVING AMOUNT OF CONVEYOR MOTOR
SC19
CHANGE CAP FROM FIRST STATE TO SECOND STATE
SC20
TRAY GUIDE IN SECOND POSITION?
No
Yes
SC21
PERFORM NEXT PROCESS ACCORDING TO CLEANING OPERATION PROCEDURE

INKJET RECORDING APPARATUS

CROSS REFERENCE TO RELATED APPLICATION

This application claims priority from Japanese Patent Application No. 2010-293965, filed on Dec. 28, 2010, the entire subject matter of which is incorporated herein by reference.

TECHNICAL FIELD

The invention relates to an inkjet recording device configured to perform an image recording by ejecting ink droplets onto a recording medium from a recording head, and more specifically, to an inkjet recording device comprising a purge mechanism configured to suck ink from the recording head by a suction pump.

BACKGROUND

An image recording device has been known that is configured to perform an image recording by ejecting ink droplets onto a recording medium based on input signals. Such an image recording device is commonly referred to as an inkjet printer. The inkjet printer implements an image recording by selectively ejecting ink droplets from nozzles of a recording head.

In the recording head, air bubbles may be generated in ink passages extending to the nozzles or the ink passages may be clogged with foreign matters. These may cause an ejection failure of ink droplets from the nozzles. In order to prevent or recover such a problem, there has been known a technique for eliminating air bubbles or foreign matters from the nozzles of the recording head, which is commonly referred to as a purge operation. The purge operation is implemented by a maintenance unit. The maintenance unit comprises a cap configured to cover the nozzles of the recording head and a pump configured to generate a suction pressure in the cap covering the nozzles of the recording head. A motor is used as a drive source of the cap and the pump. In the inkjet printer, in addition to the purge operation, a flushing operation for eliminating air bubbles and impure ink from the recording head and a wiping operation for wiping off ink adhering to the nozzles are performed. These operations are collectively referred to as a cleaning operation.

An image recording device has been known that comprises a power transmission switching device configured to switch power transmission from the motor between drive portions. The power transmission switching device is configured to transmit power to the drive portions alternately in accordance with a movement of a carriage.

As recording media onto which an image is to be recorded in the image recording device including the inkjet printer, recording media having high rigidity, e.g., compact discs (CDs) and digital versatile discs (DVDs), may be used in addition to recording sheets. Generally, when an image is recoded on a surface of a recording medium having high rigidity, e.g., a CD or a DVD, the recording medium is placed on a special tray. The tray is inserted into the image recording device via an insertion slit provided therethrough and is conveyed inside of the image recording device.

SUMMARY

In view of a recent request for further downsizing of inkjet printers, it is desired that the structure of the power transmission switching mechanism be simplified. For example, the power transmission switching mechanism may be configured as described below.

A roller pair for conveying a tray and a recording sheet and a maintenance unit are driven by a common drive source. The roller pair comprises a drive roller and a following roller. A driving force of the drive source is transmitted to the drive roller and the maintenance unit by the power transmission switching device.

The roller pair is configured such that the drive roller and the following roller are in contact with each other to be able to pinch a recording sheet therebetween for conveying the recording sheet and are separated from each other to be able to pinch the tray therebetween for conveying the tray. The driving force is transmitted from the drive source to the drive roller regardless of the position of the carriage. The drive roller is capable of rotating in both forward and reverse directions.

The driving force is transmitted from the drive source to the maintenance unit when the carriage equipped with the recording head faces the maintenance unit (the carriage is located at a position for the purge operation), and the driving force is not transmitted from the drive source to the maintenance unit when the carriage is located at a position for the image recording operation. When the forward rotation force is transmitted to the maintenance unit, the pump is actuated. When the reverse rotation force is transmitted to the maintenance unit, a communication state between the cap and the pump is changed between an established state and an interrupted state.

When the power transmission switching device of the inkjet printer is structured as described above, the forward rotation force and the reverse rotation force of the motor are transmitted to the maintenance unit during the course of the cleaning operation. The drive roller is capable of rotating in the forward and reverse directions in response to the transmission of the forward rotation force and the reverse rotation force from the motor during the course of the cleaning operation.

However, the above-described configuration may cause some problems. For example, if the tray, on which a recording medium, e.g., a CD or a DVD, is inserted into the inkjet printer via the insertion slit during the cleaning operation, the tray may be drawn into the inkjet printer and conveyed inside of the inkjet printer by the roller pair while the cleaning operation is being performed. The unexpected conveyance of the tray may cause the conveyance of the tray for a longer distance than necessary. As a result, the tray may hit against an object, e.g., a wall, existing in the inside of the inkjet printer.

An embodiment provides for an inkjet recording device configured to prevent a tray carrying a recording medium thereon from hitting against an object while the tray is inserted into the inkjet recording device during cleaning operation.

An inkjet recording device comprise a tray configured to receive a recording medium, a tray guide movable between, a first position, in which the tray guide supports the tray such that the tray guide allows the tray to enter a conveying path, configured for passage of the tray, and a second position, which is a different position from the first position with respect to a direction intersecting a direction that the conveying path extends, a first sensor configured to output a first signal indicative of the position of the tray guide, a recording portion configured to record an image on the recording medium, a cleaning mechanism configured to clean the recording portion, a first conveyor portion disposed downstream of the recording portion and upstream of the tray guide as viewed from rear to front direction and configured to convey the tray along the conveying path in a first direction from the recording portion to the tray guide and in a second direction that is reverse to the first direction, a first drive source configured to rotate in a forward direction of rotation and a reverse direction of rotation, a power transmitting portion configured to, transmit a force generated by the forward direction of rotation of the first drive source to both the cleaning mechanism and the first conveyor portion as driving force to convey the tray in the first direction and drive the cleaning mechanism, and transmit a force generated by the reverse direction of rotation of the first drive source to both the cleaning mechanism and the first conveyor portion as driving force to convey the tray in the second direction and drive the cleaning mechanism, and a control section configured to control a cleaning operation of the recording portion based on a predetermined procedure, the predetermined procedure including a plurality of processes, said control section driving the first drive source in accordance with each of the plurality of processes to control the cleaning mechanism by rotating the first drive source in either the forward direction of rotation, the reverse direction of rotation or no rotation, and drive the first drive source in the forward direction of rotation using a first predetermined amount of drive to convey the tray to a downstream side of the first conveyor portion as viewed from the rear to front direction and where the tray is not in contact with the first conveyor portion if the control section determined that, from the first signal output from the first sensor, the first sensor has detected that the tray guide is not in the second position under the cleaning operation.

An inkjet recording device comprise a tray configured to receive a recording medium, a tray guide movable between a first position, in which the tray guide supports the tray where the tray guide allows the tray to enter a conveying path, configured for passage of the tray, and a second position, which is a different position from the first position with respect to a direction intersecting a direction that the conveying path extends, a first sensor configured to output a first signal indicative of a position of the tray guide, a recording portion configured to record an image on the recording medium, a cleaning mechanism configured to clean the recording portion, a first conveyor portion configured to convey the tray along the conveying path in a first direction from the recording portion to the tray guide and in a second direction that is reverse to the first direction, a second conveyor portion disposed upstream of the first conveyor portion as viewed from rear to front direction and configured to convey the tray in the first and the second directions along the conveying path, the second conveyor portion comprise a first roller and a second roller, the second roller being movable in a direction intersecting the conveying path as viewed from up to down direction between a contacting state in which the second roller is in contact with the first roller and a separated state in which the second roller is separated from the first roller, a first drive source configured to rotate in a forward direction of rotation and a reverse direction of rotation, a second drive source configured to move the second roller between the contacting state and the separated state, a power transmitting portion configured to transmit a force generated by the forward direction of rotation of the first drive source to both the cleaning mechanism and the first conveyor portion as driving force to convey the tray in the first direction and drive the cleaning mechanism, and transmit a force generated by the reverse direction of rotation of the first drive source to both the cleaning mechanism and the first conveyor portion as driving force to convey the tray in the second direction and drive the cleaning mechanism, a second sensor configured to output a second signal indicative of a driving amount of the first drive source, and a control section configured to control a cleaning operation of the recording portion based on a predetermined procedure, the predetermined procedure including a plurality of processes, said control section driving the first drive source in accordance with each of the plurality of processes to control the cleaning mechanism by rotating the first drive source in either the forward direction of rotation, the reverse direction of rotation or no rotation, and control the second drive source to move the second roller from the contacting state to the separated state if the control section determined that, from the first signal output from the first sensor, the first sensor has detected that the tray guide is not in the second position and the control section determined that, from the second signal output from the second sensor, the driving amount of the first drive source in the reverse direction of rotation for any one of the plurality of processes is greater than or equal to a first cleaning predetermined amount.

BRIEF DESCRIPTION OF THE DRAWINGS

Illustrative aspects will be described in detail with reference to the following figures in which like elements are labeled with like numbers and in which:

FIG. 9 is a control flowchart for explaining a media tray discharging process in the embodiment according to one or more aspects of the invention;

FIG. 10 is a control flowchart for explaining a media tray discharging process in a first variation according to one or more aspects of the invention;

FIG. 11 is a control flowchart for explaining a media tray discharging process in a second variation according to one or more aspects of the invention;

DETAILED DESCRIPTION

Figure 1:
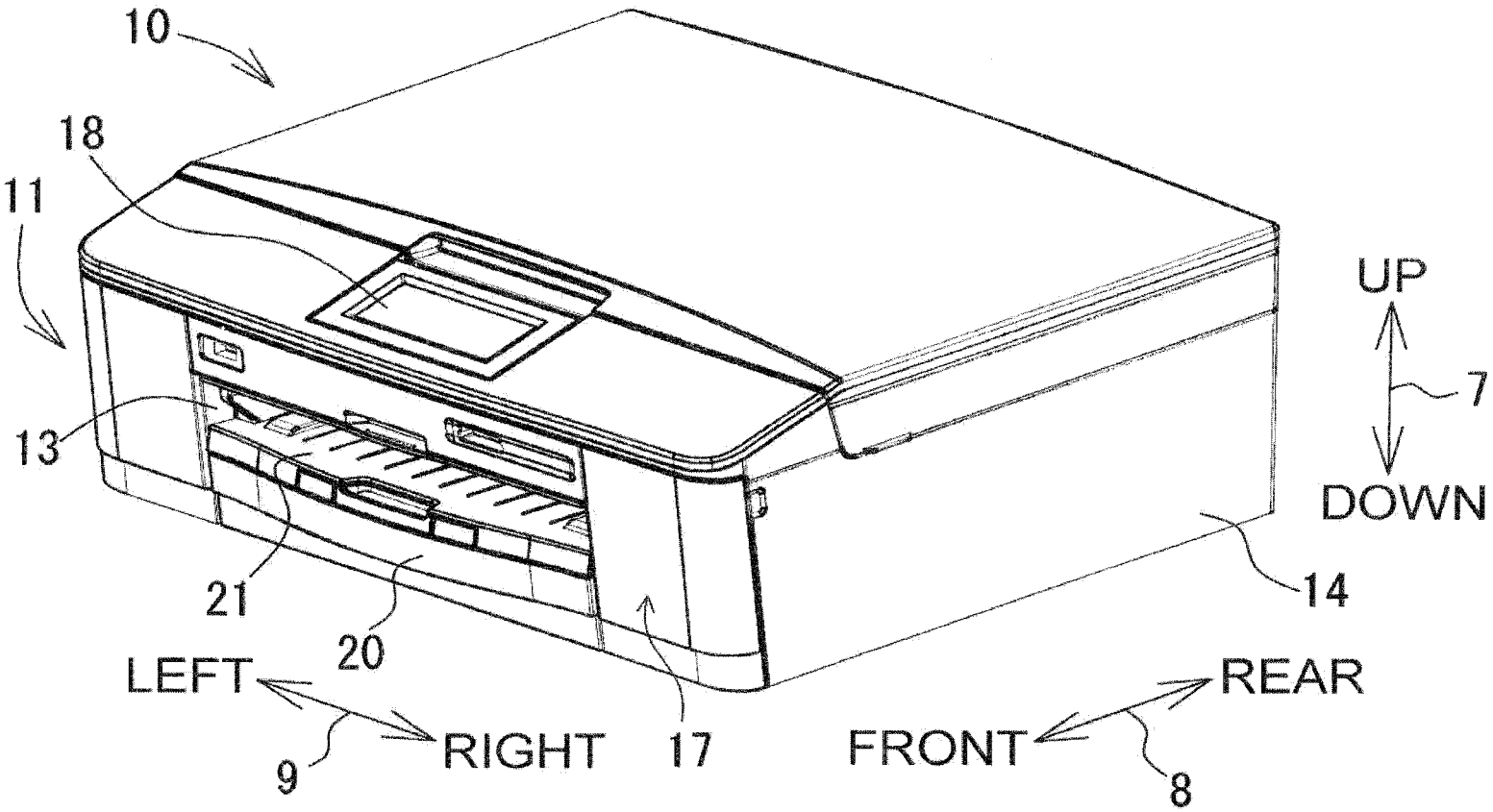
FIG. 1 is a perspective view showing an appearance of a multifunction device in an embodiment according to one or more aspects of the invention.

Hereinafter, an embodiment according to aspects of the invention will be described with reference to the accompanying drawings. The embodiment described below will be an example of the invention. It would be apparent to those skilled in the art that various changes, arrangements and modifications may be applied therein without departing from the spirit and scope of the invention. An up-down direction 7 is defined with reference to an orientation of a multifunction device 10 that is disposed in which it is intended to be used as shown in FIG. 1. A side, on which a front opening 13 is provided, of the multifunction device 10 is defined as the front of the multifunction device 10. A front-rear direction 8 is defined with reference to the front of the multifunction device 10 as shown in FIG. 1. A right-left direction 9 is defined when the multifunction device 10 is viewed from its front.

As shown in FIG. 1, the multifunction device 10 (an example of an inkjet recording device of the invention) has a substantially thin box shape. The multifunction device 10 comprises a printing portion 11 at its lower part. The multifunction device 10 has various functions, e.g., a facsimile function and a printing function. Although having a single-sided image recording function only as the printing function in this embodiment, the multifunction device 10 may have a double-sided image recording function in addition to the single-sided image recording function.

The printing portion 11 comprises a housing 14. The housing 14 comprises a front wall 17, which extends in the up-down direction 7 and the right-left direction 9 and defines the front of the housing 14, and a rear wall 16 (See FIG. 8B), which faces the front wall 17 and defines the rear of the housing 14. The front opening 13 is formed in a substantially middle of the front wall 17. A sheet feed tray 20 and a sheet discharge tray 21 can be inserted into and removed from the housing 14 through the front opening 13. Recording sheets of desired sizes can be placed on the sheet feed tray 20.

Figure 2:
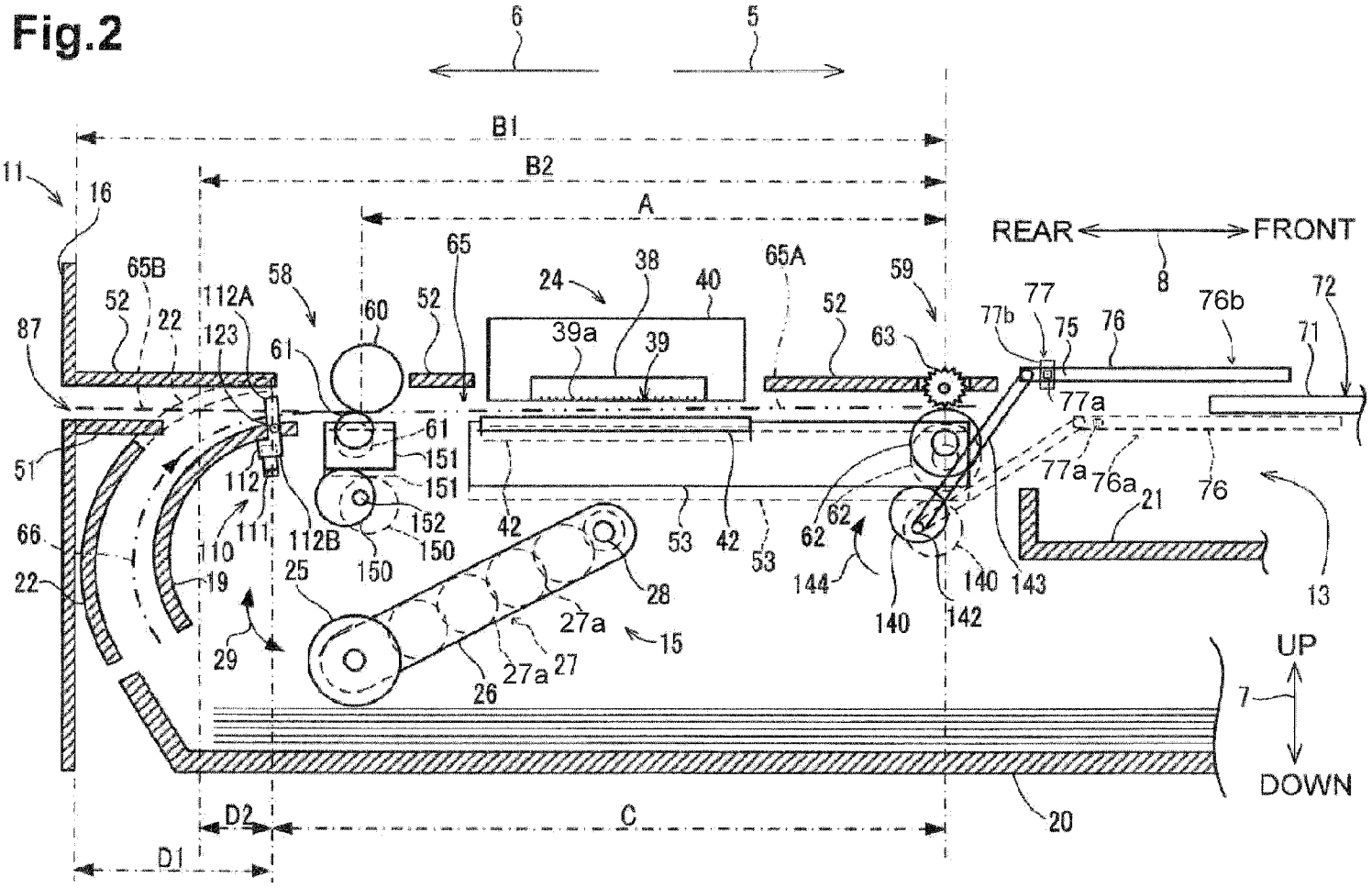
FIG. 2 is a vertical schematic sectional view showing an internal structure of a printing portion of the multifunction device in the embodiment according to one or more aspects of the invention.

As shown in FIG. 2, the printing portion 11 comprises a sheet feeding portion 15 and a recording portion 24 (an example of a recording portion of the invention). The sheet feeding portion 15 is configured to feed recording sheets, one by one, to a curved path 66, by separating a recording sheet from a stack of sheets. The recording portion 24 is configured to record an image onto the recording sheet by a method of inkjet recording. The printing portion 11 is configured to record an image onto a recording sheet based on print data received from external devices. The multifunction device 10 also has a function of recording an image onto a surface of a recording medium 69 (an example of a recording medium of the invention) (See FIG. 3), e.g., a CD-ROM and a DVD-ROM, that has a thickness greater than the recording sheet, by the recording portion 24. The recording medium 69 is placed on a media tray 71 (an example of a tray of the invention) for the image recording. The media tray 71 carrying the recording medium 69 thereon is then inserted into the multifunction device 10 and is conveyed inside the printing portion 11. This function will be described later.

As shown in FIG. 2, the sheet feeding portion 15 is provided above the sheet feed tray 20, and comprises a sheet feed roller 25, a sheet feed arm 26, and a power transmission mechanism 27. The sheet feed roller 25 is supported by a shaft at one end of the sheet feed arm 26. The sheet feed arm 26 is supported by a shaft 28 at the other end thereof and is configured to pivot in directions shown by an arrow 29 about the shaft 28. With this configuration, the sheet feed roller 25 can move toward and away from the sheet feed tray 20. The sheet feed roller 25 is configured to be rotated by a driving force transmitted from a sheet feed motor 101 (See FIG. 7) by the power transmission mechanism 27, in which a plurality of gears 27*a* are engaged with each other. The sheet feed roller 25 is also configured to supply recording sheets to the curved path 66, one by one, by separating a recording sheet from the stack placed on the sheet feed tray 20.

As shown in FIG. 2, the printing portion 11 comprises the curved path 66 and a straight path 65 (an example of a conveying path) in its inside. The curved path 66, which is shown by a dotted-and-dashed line in FIG. 2, extends from a rear end of the sheet feed tray 20 to a first roller pair 58 and is capable of guiding a recording sheet therethrough. The straight path 65, a part of which is shown by a double dotted-and-dashed line and another part of which is shown by a dashed line in FIG. 2, extends from a position above the sheet discharge tray 21 in the front opening 13 of the front wall 17 to the rear opening 87 of the rear wall 16 via the recording portion 24 and is capable of guiding a recording sheet and the media tray 71 therethrough.

The curved path 66 extends obliquely rearward and upward from the rear end of the sheet feed tray 20 and is turned toward the front to further extend to the first roller pair 58. A recording sheet is warped and guided in a sheet conveying direction, which is shown by an arrow added to the dotted-and-dashed line in FIG. 2, along the curved path 66. The curved path 66 is connected to the straight path 65 at the first roller pair 58 to provide a continuous path. Therefore, the recording sheet is guided to the straight path 65 (more specifically, a first path 65A constituting the straight path 65) via the curved path 66. The curved path 66 is defined by an inner guide member 19 and an outer guide member 22 that face with each other at a predetermined distance away from each other.

The straight path 65 extends linearly in the front-rear direction 8 and comprises the first path 65A shown by the double dotted-and-dashed line in FIG. 2 and a second path 65B shown by the dashed line in FIG. 2. The first path 65A is a straight path that extends forward from the first roller pair 58 to the position above the sheet discharge tray 21 in the front opening 13 in the front-rear direction 8. The first path 65A is defined by an upper guide member 52, a platen 42, and a platen support member 53, which are disposed opposite to each other at a predetermined distance away from each other. The platen support member 53 is disposed to support the platen 42. The second path 65B is a straight path that extends rearward from the first roller pair 58 to the rear opening 87, i.e., extends in a direction reverse to the direction that the first path 65A extends. That is, the first path 65A and the second path 65B constitutes the continuous straight path 65 by connecting at the first roller pair 58. The second path 65B is defined by the upper guide member 52 and a lower guide member 51, which are disposed opposite to each other at a predetermined distance away from each other.

The recording sheet is guided along the straight path 65 in a direction from the recording portion 24 to a tray guide 76 (an example of a tray guide of the invention), i.e., in a first direction 5 from the rear to the front of the multifunction device 10. The recording sheet is then discharged onto the discharge tray 21 after an image is recorded thereon by the recording portion 24. The media tray 71 inserted into the printing portion 11 via the front opening 13 is guided along the straight path 65 in the first direction 5 and a second direction 6 that is reverse to the first direction 5, i.e., a direction from the front to the rear of the multifunction device 10 (an example of a second direction of the invention) (See FIG. 2). That is, the media tray 71 passes through the straight path 65.

Figure 3:
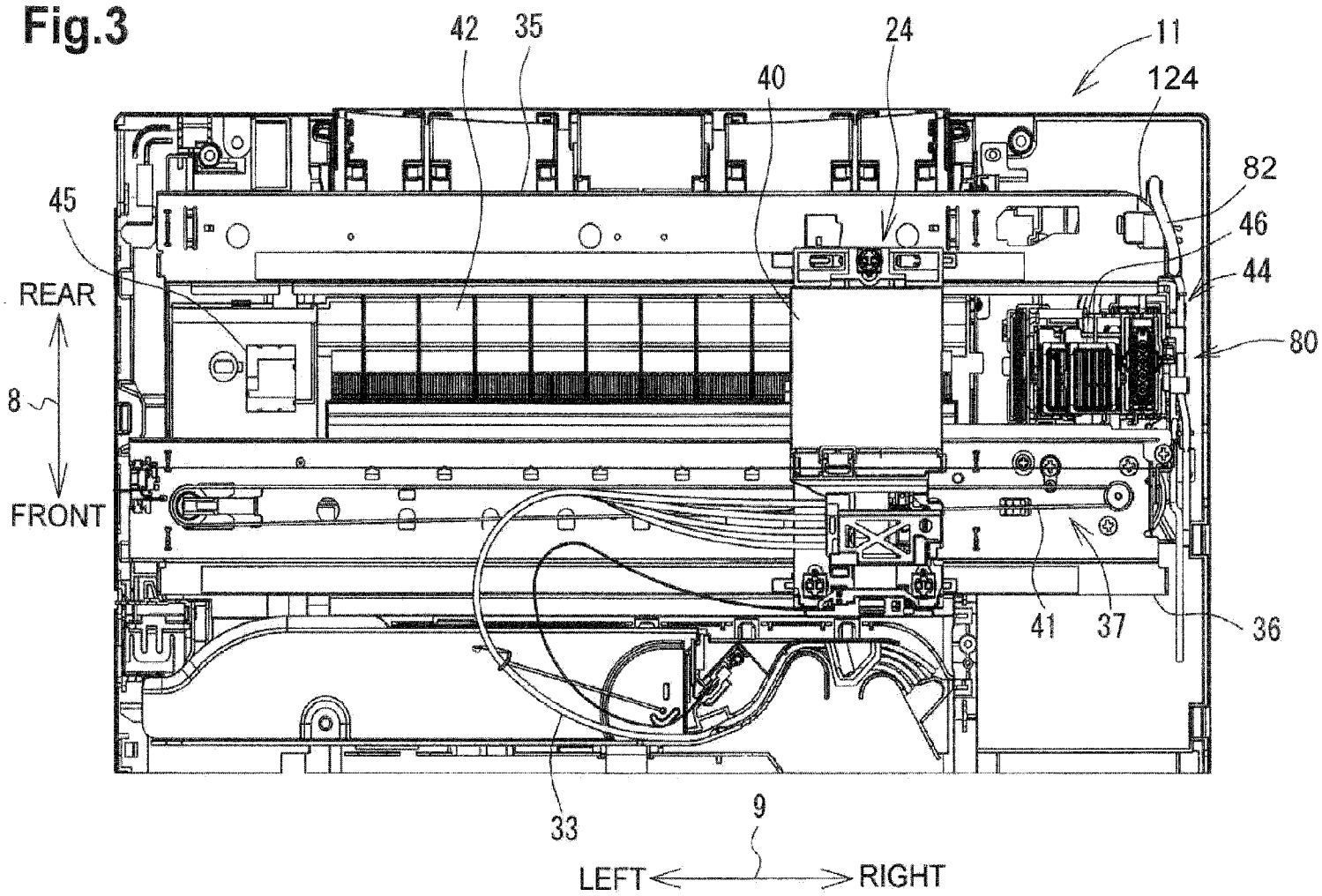
FIG. 3 is a partial plan view showing the internal structure of the printing portion of the multifunction device in the embodiment according to one or more aspects of the invention.

The recording portion 24 is disposed in the straight path 65, and more specifically, above the straight path 65. As shown in FIGS. 2 and 3, the recording portion 24 comprises a carriage 40 that is equipped with a recording head 38 (an example of a recording head of the invention). The carriage 40 is configured to reciprocate in a direction that intersects the first direction 5 and extends along a nozzle surface 39 (described later), i.e., a main scanning direction (corresponding to a third direction of the invention). In this embodiment, the third direction corresponds with the right-left direction 9.

The carriage 40 is supported by, for example, two guide rails 35, 36 attached to a frame (not shown) disposed inside the printing portion 11. More specifically, the guide rails 35, 36 extend in the right-left direction 9 and are disposed at a predetermined distance away from each other in the front-rear direction 8. The carriage 40 is disposed to bridge between the guide rails 35, 36. With this structure, the carriage 40 can slide on the guide rails 35, 36 in the right-left direction 9. A belt drive mechanism 37 is disposed at an upper surface of the guide rail 36. The belt drive mechanism 37 comprises a belt 41, which is connected with the carriage 40. A driving force is transmitted from a carriage drive motor 103 (See FIG. 7) to the belt drive mechanism 37 to slide the carriage 40 in the right-left direction 9.

As shown in FIG. 2, the recording head 38 is exposed from a bottom of the carriage 40. The recording head 38 is supplied with ink of cyan, magenta, yellow, and black via respective ink tubes 33 (See FIG. 3) from respective ink cartridges (not shown). A plurality of nozzles 39*a* (an example of nozzles of the invention) are formed in the nozzle surface 39 (an example of a nozzle surface of the invention), which is a bottom surface of the recording head 38. The nozzles 39*a* are provided for each color of ink of cyan, magenta, yellow, and black. Each color of ink of cyan, magenta, yellow, and black is ejected from each nozzle as an ink droplet.

With this structure, the recording head 38 ejects ink droplets onto a recording sheet while scanning the recording sheet that is being conveyed above the platen 24 disposed under the recording portion 24. Therefore, an image is recorded on the recording sheet. The platen 24 supports a recording sheet thereon during the recording operation. As described later, the recording portion 24 is capable of recording an image on a surface of a recording medium 69.

As shown in FIG. 2, the first roller pair 58 (an example of a second conveyor portion) is disposed upstream of the recording portion 24 in the first direction 5 in the straight path 65. The first roller pair 58 is disposed on the opposite side of the recording portion 24 from the tray guide 76. The first roller pair 58 comprises a first conveyor roller 60 (corresponding to a first roller of the invention) disposed above the straight path 65 and a pinch roller 61 (corresponding to a second roller of the invention) disposed below the straight path 65 to be opposite to the first conveyor roller 60. The pinch roller 61 is pressed against a roller surface of the first conveyor roller 60 by an elastic member (not shown), e.g., a spring. The first roller pair 58 is configured to convey a recording sheet in the first direction 5 along the straight path 65 by pinching the recording sheet therebetween and convey a recording medium 69 in the first direction 5 and the second direction 6 along the straight path 65 by pinching the recording medium 69 therebetween.

A second roller pair 59 (an example of a first conveyor portion) is disposed between the recording portion 24 and the tray guide 76, i.e., downstream of the recording portion 24 in the first direction 5 in the straight path 65. The second roller pair 59 comprises a second conveyor roller 62 disposed below the first path 65A and a spur 63 disposed above the first path 65A to be opposite to the second conveyor roller 62. The spur 63 is pressed against a roller surface of the second conveyor roller 62 by an elastic member (not shown), e.g., a spring. The second roller pair 59 is configured to convey a recording sheet, which has passed the recording portion 24, toward the sheet discharge tray 21 along the straight path 65 in the first direction 5 by pinching the recording sheet therebetween, and convey a recording medium 69 along the straight path 65 in the first direction 5 and the second direction 6 by pinching the recording medium 69 therebetween.

The first conveyor roller 60 and the second conveyor roller 62 are rotated by a driving force transmitted from a conveyor motor 102 (described later) (See FIG. 7) via a power transmission mechanism (described later and not shown). The first conveyor roller 60 and the second conveyor roller 62 are intermittently driven during the image recording operation. Accordingly, an image is recorded on a recording sheet or a recording medium 69 while the recording sheet or the recording medium 69 is conveyed by the predetermined line feed width.

As shown in FIG. 2, the printing portion 11 comprises a sheet sensor 110 (an example of a third sensor of the invention) configured to detect a recording sheet and the media tray 71 to be conveyed along the straight path 65. The sheet sensor 110 is disposed in the straight path 65 upstream of the first roller pair 58 in the first direction 5.

The sheet sensor 110 comprises a rotary body 112 including sensing elements 112A, 112B and a photosensor 111, e.g., a photointerrupter, including a light-emitting device, e.g., a light-emitting diode, and a photoreceptor, e.g., a phototransistor, for receiving light emitted from the light-emitting device. The rotary body 112 is disposed to be rotatable about a support shaft 123. The sensing element 112A extends from the support shaft 123 and protrudes in the straight path 65. While no external force is applied on the rotary body 112, the sensing element 112B is located in an optical path, in which light travels from the light-emitting device to the photoreceptor in the photosensor 111, and interrupts the light traveling in the optical path. When the rotary body 112 rotates by which a leading edge of a recording sheet or a leading edge of the media tray 71 presses the rotary body 112, the optical path becomes clear of the sensing element 112B and the light travels in the optical path from the light-emitting device to the photoreceptor.

Figure 7:
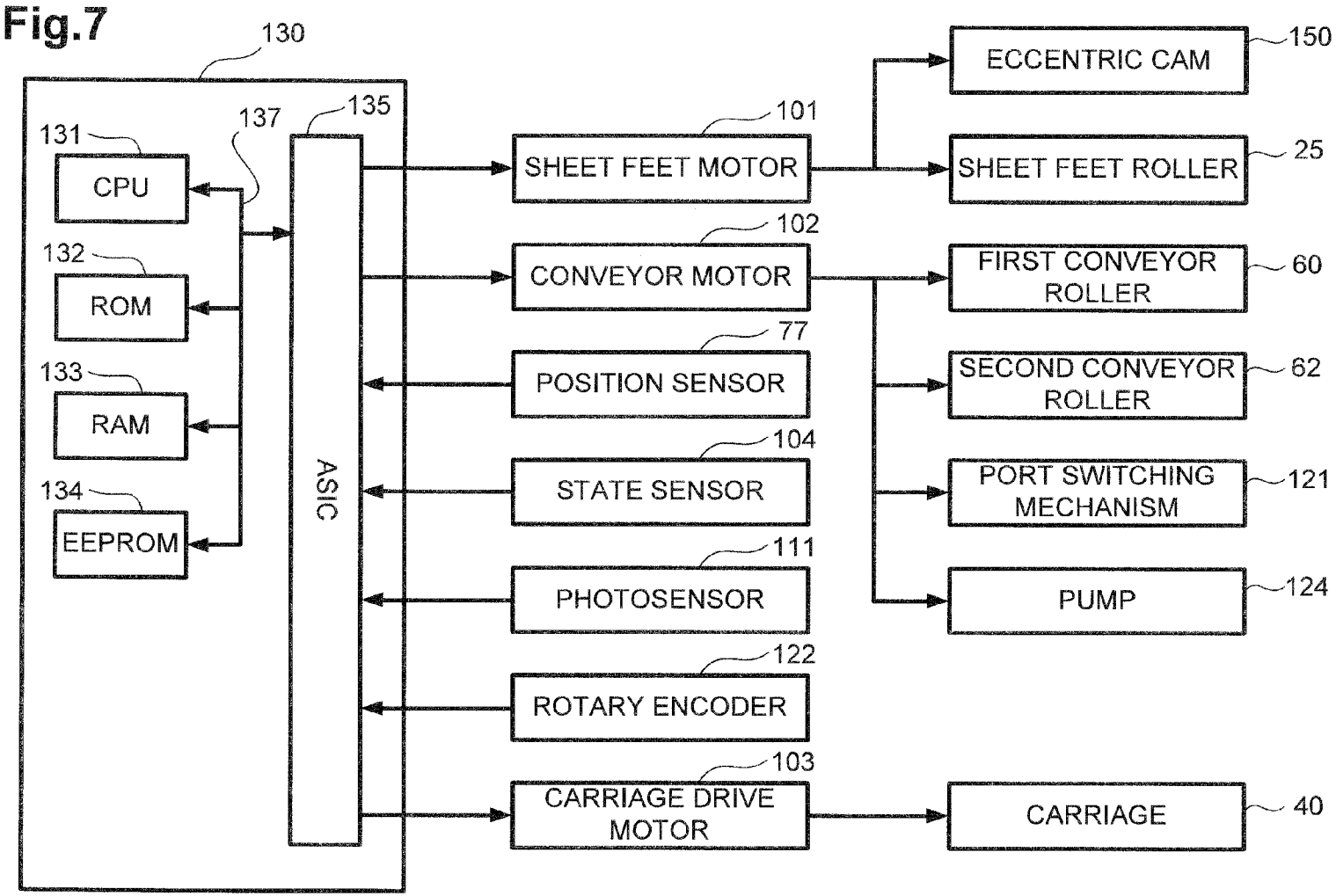
FIG. 7 is a block diagram showing a configuration of a controller connected with other elements in the embodiment according to one or more aspects of the invention.

As shown in FIG. 7, the multifunction device 10 comprises a rotary encoder 122 configured to detect a driving amount of the conveyor motor 102.

The rotary encoder 122 is fixed to a shaft (not shown) of the conveyor motor 102 and comprises an encoder disk (not shown) that rotates together with the shaft and a photosensor (not shown). The encoder disk comprises transparent portions, through which light passes, and nontransparent portions, through which light does not pass. The transparent portions and the nontransparent portions are alternately provided in patterns with equal pitch in a circumference direction of the center that is concentric with the center of rotation of the encoder disk. The photosensor is disposed opposite to a first pattern of the patterns formed on the encoder disk. When the encoder disk rotates with the shaft of the conveyor motor 102, the photosensor detects the patterns arranged on the encoder disk and generates a pulse signal every detection. The photosensor outputs the generated pulse signals to a controller 130 (described later). The controller 130 is configured to calculate the driving amount of the conveyor motor 102 based on the pulse signals received from the photosensor. The rotary encoder 122 and the controller 130 constitutes a second sensor of the invention.

Figure 4:
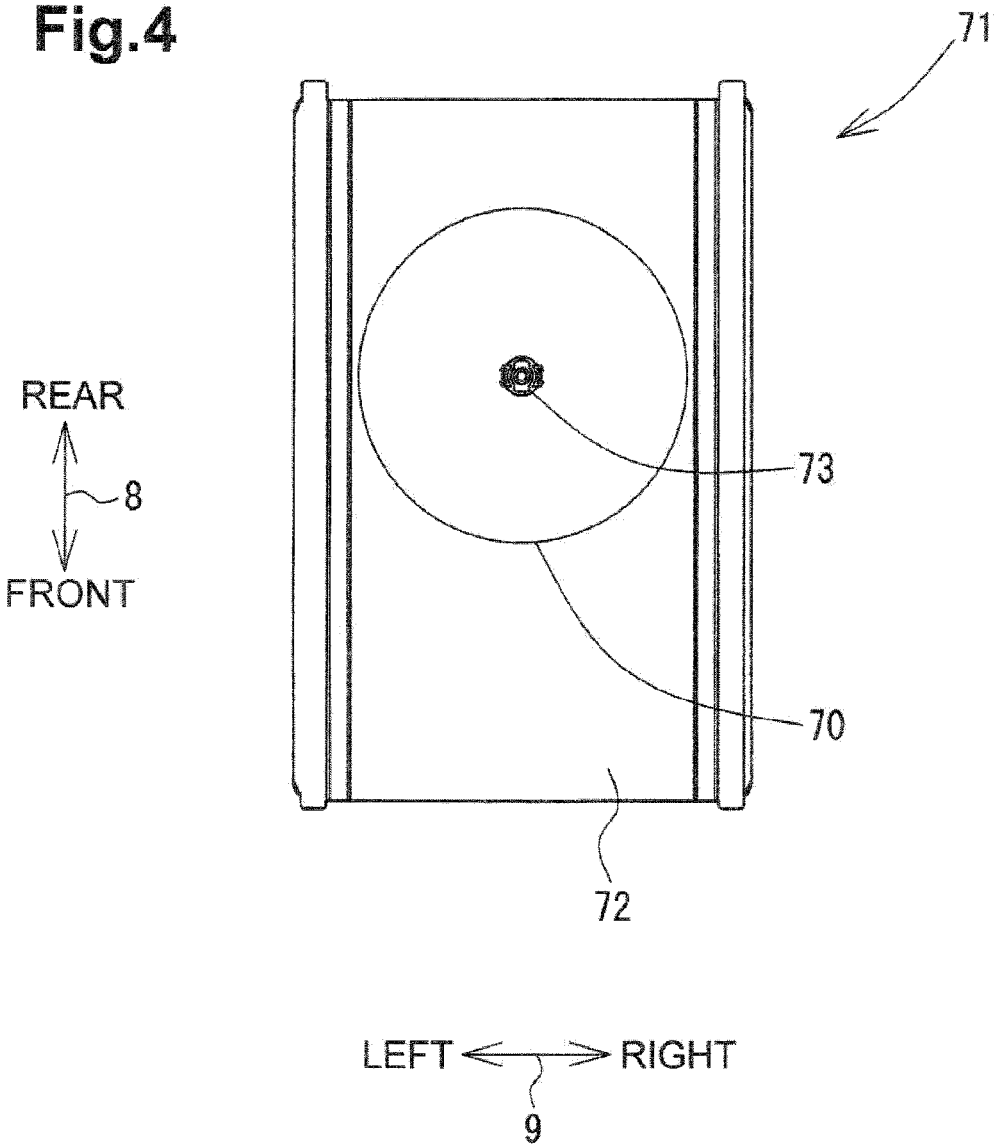
FIG. 4 is a plan view showing a media tray in the embodiment according to one or more aspects of the invention.

As shown in FIG. 4, the media tray 71 is a thin plate made of resin. As shown in FIGS. 2 and 4, the media tray 71 is placed on the tray guide 76 with its upper surface 72 upward and is inserted, in the second direction 6, into the multifunction device 10 via the front opening 13. Then, the media tray 71 is conveyed along the straight path 65 from the front opening 13 by the first roller pair 58 and the second roller pair 59. In FIG. 4, orientations (the up-down direction 7, the front-rear direction 8, and the right-left direction 9) of the media tray 76 are defined while the media tray 71 is inserted in the multifunction device 10.

A media holding portion 70, on which a recording medium 69 can be placed, is formed in the upper surface 72 of the media tray 71. The media holding portion 71 is a circular recess having a diameter that is slightly larger than or equal to a diameter of the recording medium 69 to be placed thereon, e.g., a circular CD-ROM or DVD-ROM. A circular engaging portion 73 protrudes upward from the substantially center of the recess. The circular CD-ROM or DVD-ROM commonly has a circular hole at its substantially center. The engaging portion 73 is the same in size as the hole of the CD-ROM or DVD-ROM. The engaging portion 73 engages the hole of the CD-ROM or DVD-ROM placed on the media holding portion 70. With this structure, the recording medium 69 does not move in the front-rear direction 8 or the right-left direction 9 when the recording media 69 is placed on the media hold portion 70.

As shown in FIG. 2, the tray guide 76, which can support the media tray 71 thereon, is disposed above the sheet discharge tray 21. The tray guide 76 comprises a substantially thin plate-shaped bottom plate 75 and right and left guide plates (both not shown). The right and left guide plates stand from respective side ends of the bottom plate 75 in the right-left direction 9 and extend along a direction that the media tray 71 is to be inserted (the front-rear direction 8). The media tray 71 is placed on an upper surface of the bottom plate 75. A distance between the right guide plate and the left guide plate is slightly greater than or equal to a width of the media tray 71 (the right-left direction 9). With this structure, the media tray 71 does not move in the right-left direction 9 when the media tray 71 is inserted into the multifunction device 10 via the front opening 13 with placed on the bottom plate 75 of the tray guide 76.

The tray guide 76 is movable between a first position 76*a* (corresponding to a first position of the invention) shown by a dashed line in FIG. 2 and a second position 76*b* (corresponding to a second position of the invention) shown by a solid line in FIG. 2. In the first position 76*a*, the tray guide 76 supports the media tray 71 so as to allow the media tray 71 to enter the straight path 65. The second position 76*b* is different from the first position with respect to the up-down direction 7. In this embodiment, the second position is higher than the first position.

In this embodiment, the tray guide 76 is movable between the first position 76*a* or the second position 76*b* with a structure as described below. The frame (not shown) of the multifunction device 10 is disposed on the right and left of the tray guide 76. The frame has slits therein. The tray guide 76 comprises protrusions (not shown) that protrude from both side surfaces of the tray guide 76, respectively. The protrusions of the tray guide 76 are inserted in the respective slits of the frame. With this structure, the tray guide 76 is slidable along the slits. The tray guide 76 can be fixed at upper ends and lower ends of the respective slits. When the tray guide 76 is positioned at the lower ends of the slits, the tray guide 76 is in the first position. When the tray guide 76 is positioned at the upper ends of the slits, the tray guide 76 is in the second position. The structure for moving the tray guide 76 is not limited to the above-described structure.

A position sensor 77 (an example of a first sensor of the invention, See FIG. 2) that is configured to detect the position of the tray guide 76 is disposed in the printing portion 11.

The position sensor 77 is attached to the left side surface of the tray guide 76, for example. The position sensor 77 comprises a light-emitting portion 77*a*, which irradiates light in a direction distance away from the tray guide 76, i.e., in the leftward direction, and a photoreceptor 77*b*, which is positioned opposite to the light-emitting portion 77*a* provided to the frame of the printing portion 11. That is, when the tray guide 76 is in the second position, light irradiated from the light-emitting portion 77*a* is received by the photoreceptor 77*b*. Thus, the position sensor 77 detects that the tray guide 76 is in the second position. When the tray guide 76 moves from the second position, the light-emitting position 77*a* also moves with the tray guide 76, so that light irradiated from the light-emitting portion 77*a* is not received by the photoreceptor 77*b*. Thus, the position sensor 77 detects that the tray guide 76 is not in the second position.

As shown in FIG. 2, the second conveyor roller 62 of the second roller pair 59 can change its state between a contacting state where the second conveyor roller 62 is in contact with the spur 63 (shown by a solid line in FIG. 2) and a separated state where the second conveyor roller 62 is separated from the spur 63 (shown by a dashed line in FIG. 2). When the second conveyor roller 62 is in the contacting state, the second roller pair 59 can pinch a recording sheet therein. Therefore, the second roller pair 59 conveys the recording sheet along the straight path 65. When the second conveyor roller 62 is in the separated state, the second conveyor roller 62 and the spur 63 are separated from each other while a clearance suitable for pinching the media tray 71 is created therebetween. Therefore, the second roller pair 59 conveys the media tray 71 along the straight path 65.

The platen 42 is movable an upper position and a lower position. When the platen 42 is in the upper position (shown by a solid line in FIG. 2), a clearance between the platen 42 and the recording portion 24 allows a recording sheet to pass below the recording portion 24. When the platen 42 is in the lower position (shown by a dashed line in FIG. 2), a clearance between the platen 42 and the recording portion 24 allows the media tray 71 to pass below the recording portion 24.

The downward movements of the second conveyor roller 62 and the platen 42 are implemented by, for example, an eccentric cam 140 and the platen support member 53 disposed below the second conveyor roller 62 and the platen 42. The eccentric cam 140 is rotatably supported by the frame (not shown) constituting the housing 14 of the multifunction device 10 while an axial direction of the eccentric cam 140 corresponds with the right-left direction 9. The eccentric cam 140 is a disc that its radius from a shaft 142 to its outside edge periodically changes. The platen support member 53 is supported while placed on the eccentric cam 140. The second conveyor roller 62 is rotatably supported by the platen support member 53. The platen 42 is supported by the platen support member 53 as described above.

The shaft 142 of the eccentric cam 140 is connected with the tray guide 76 via an interlock member 143. The interlock member 143 is integral with the shaft 142. The interlock member 143 rotates about the shaft 142 in synchronization with the rotation of the shaft 142. With this structure, as the tray guide 76 changes from the second position to the first position, the interlock member 143 rotates downward (in the clockwise direction in the drawing sheet of FIG. 2). That is, the interlock member 143 changes a state shown by a solid line to a state shown by a dashed line in FIG. 2. In accordance with this change, the shaft 142 rotates in a direction shown by an arrow 144 and the eccentric cam 140 rotates also. With the rotation of the eccentric cam 140, the circumference of the eccentric cam 140 slides over the platen support member 53. In the eccentric cam 140, its radius from the shaft 142 to its outside edge changes periodically. Thus, the platen support member 52 moves in the up-down direction 7. The second conveyor roller 62 and the platen 42 move in the up-down direction 7 with the movement of the platen support member 53 in the up-down direction 7.

As shown in FIG. 2, the pinch roller 61 of the first roller pair 58 can change its state between a contacting state (corresponding to a contacting state of the invention) where the pinch roller 61 is in contact with the first conveyor roller 60 (shown by a solid line in FIG. 2) and a separated state (corresponding to a separated state of the invention) where the pinch roller 61 is separated from the first conveyor roller 60 (shown by a dashed line in FIG. 2). When the pinch roller 61 is in the contacting state, the first roller pair 58 can pinch a recording sheet therein. Therefore, the first roller pair 58 conveys the recording sheet along the straight path 65. When the pinch roller 61 is in the separated state, the pinch roller 61 and the first conveyor roller 60 are separated from each other while a clearance suitable for pinching the media tray 71 is created therebetween. Therefore, the first roller pair 58 conveys the media tray 71 along the straight path 65.

The downward movement of the pinch roller 61 is implemented by an eccentric cam 150 and a roller support member 151 disposed below the pinch roller 61. The eccentric cam 150 is rotatably supported by the frame (not shown) constituting the housing 14 of the multifunction device 10. An axial direction of the eccentric cam 150 corresponds with the right-left direction 9. The eccentric cam 150 is a disc that its radius from a shaft 152 to its outside edge changes periodically. The roller support member 151 is supported while placed on the eccentric cam 150. The pinch roller 61 is rotatably supported by the roller support member 151.

In this embodiment, the eccentric cam 150 is rotated by a driving force transmitted from the sheet feed motor 101 (an example of a second drive source of the invention) (See FIG. 7). With the rotation of the eccentric cam 150, the circumference of the eccentric cam 150 slides over the roller support member 151. In the eccentric cam 150, its radius from the shaft 152 to its outside edge changes periodically. Thus, the roller support member 151 moves in the up-down direction 7. The pinch roller 61 moves in the up-down direction with the movement of the roller support member 151 in the up-down direction 7. That is, the sheet feed motor 101 changes the state of the pinch roller 61 between the contacting state and the separated state.

The conveyor motor 102 (an example of a first drive source of the invention) (See FIG. 7) can rotate in a forward direction (an example of a first driving state of the invention) and a reverse direction (an example of a second driving state of the invention). The rotation in the forward direction may be the second driving state of the invention and the rotation in the reverse direction may be the first driving state of the invention.

The power transmission mechanism (not shown) (an example of a power transmitting portion of the invention) comprises gears, e.g., planet gears. The power transmission mechanism is configured to transmit a forward rotation force of the conveyor motor 102 to a pump 124 (an example of a sucking mechanism of the invention) (See FIG. 7) and a reverse rotation force of the conveyor motor 102 to a port switching mechanism 121 (an example of a switching mechanism of the invention) and a wiper blade 56. When the forward rotation force of the conveyor motor 102 is transmitted to the first conveyor roller 60 and the second conveyor roller 62 by the power transmission mechanism, the first conveyor roller 60 and the second conveyor roller 62 rotate in a direction that conveys the media tray 71 in the first direction 5. When the reverse rotation force of the conveyor motor 102 is transmitted to the first conveyor roller 60 and the second conveyor roller 62 by the power transmission mechanism, the first conveyor roller 60 and the second conveyor roller 62 rotate in a direction that conveys the media tray 71 in the second direction 6.

As shown in FIG. 3, the printing portion 11 comprises areas, which are disposed within a reciprocation range of the recording portion 24 and where a recording sheet and the media tray 71 do not pass through, on opposite sides of the platen 42 in the right-left direction. One of the areas, e.g., the right area, is used as a withdrawn position of the recording portion 24. A maintenance unit 80 is disposed at the withdrawn position of the recording portion 24. The maintenance unit 80 comprises a purge mechanism 44 and a waste liquid tank (not shown).

The purge mechanism 44 is configured to perform a purge operation for eliminating air bubbles or foreign matters by suction of ink from the nozzles 39*a* of the recording head 38. As shown in FIGS. 3 and 5, the purge mechanism 44 comprises a cap 46 that covers the nozzles 39*a* of the recording head 38, an exhaust cap 120 that covers exhaust holes of the recording head 38, a pump 124, a lifting mechanism 55, and a pump tube 82, and a wiper blade 56. The pump 124 is configured to perform suction by connecting with the cap 46 or the exhaust cap 120. The lifting mechanism 55 is configured to move the cap 46 and the exhaust cap 120 up or down such that the cap 46 and the exhaust cap 120 contact with the recording head 38 or are separated from the recording head 38. The pump tube 82 connects the pump 124 and the waste liquid tank with each other. The wiper blade 56 is configured to wipe the nozzle surface 39.

The cap 46 is made of, for example, rubber. The cap 46 directly contacts the nozzle surface 39 (See FIG. 2) by the lifting mechanism 55 and covers the nozzles 39*a* while leaving a space between the nozzle surface 39 and the cap 46.

Inside of the cap 46 is divided into two spaces, one of which corresponds to the nozzles 39*a* for color ink (cyan, magenta, yellow) and the other of which corresponds to the nozzles 39*a* for black ink. One of the spaces is created between the cap 46 and a part of the nozzle surface 39 corresponding to the nozzles 39*a* for color ink and the other thereof is created between the cap 46 and a part of the nozzle surface 39 corresponding to the nozzles 39*a* for black ink. Although not shown in the drawings, a suction hole is provided in a bottom of the cap 46 in each space. Each suction hole is connected with the pump 124 or the waste liquid tank via the port switching mechanism 121. The exhaust cap 120 is also made of, for example, rubber. The exhaust cap 120 also intimately contacts the nozzle surface 39 and covers the exhaust holes of the recording head 38.

The pump 124 is a rotary tube pump and comprises a casing having an inner wall surface, and a roller configured to rotate and move along the inner wall surface. The pump tube 82 is disposed between the roller and the inner wall surface. When the roller is driven in this state, ink in the pump tube 82 is squeezed from the pump tube 82 from an upstream side (the suction holes of the cap 46) to a downstream side (the waste liquid tank).

Figure 5A:
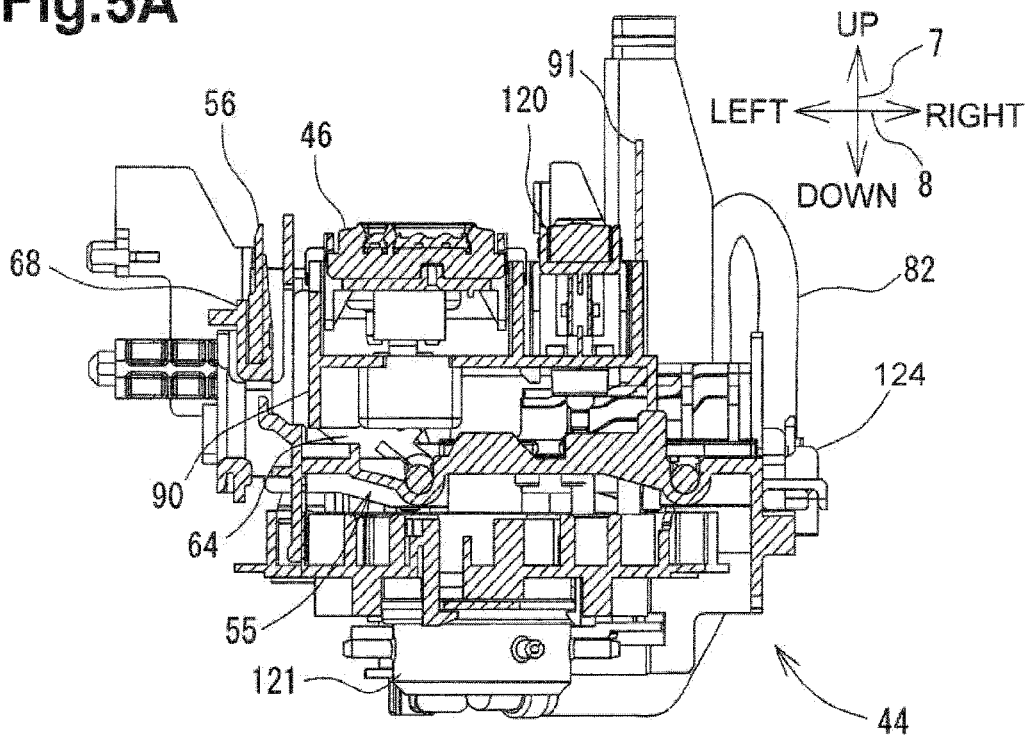
FIG. 5A is a sectional view showing a purge mechanism, wherein a cap is not lifted up in the embodiment according to one or more aspects of the invention.
Figure 5B:
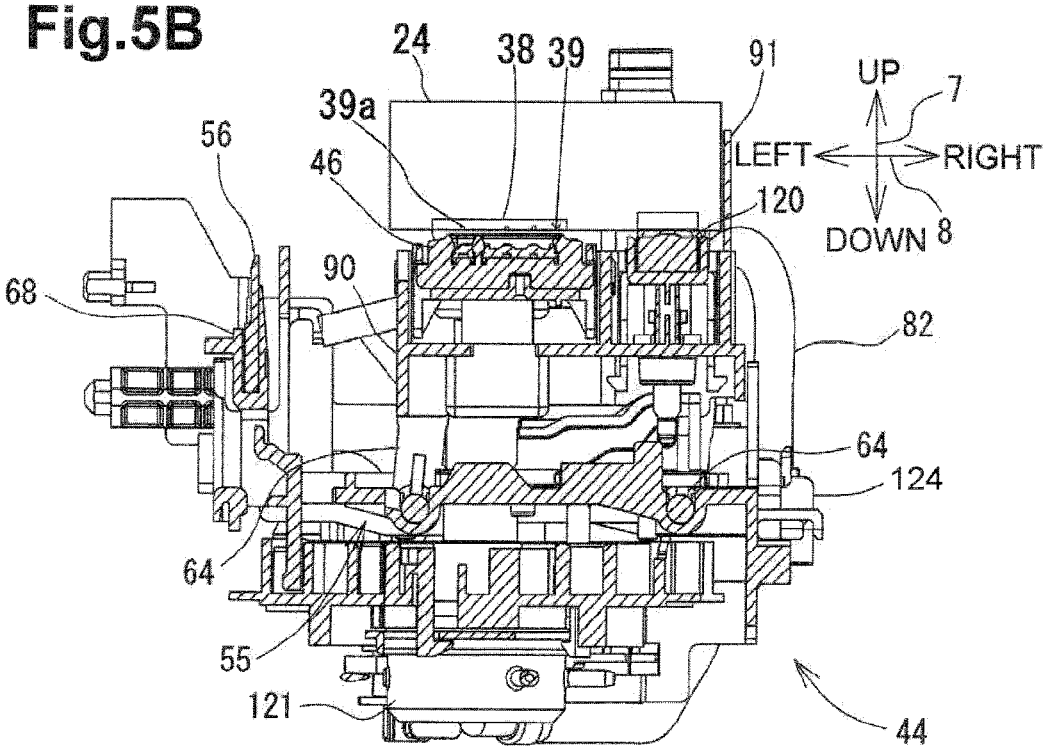
FIG. 5B is a sectional view showing the purge mechanism, wherein the cap is lifted up in the embodiment according to one or more aspects of the invention.

As shown in FIG. 5A, the lifting mechanism 55 comprises a pair of isometric links 64 disposed at each side thereof in the right-left direction 8. By rotation of the isometric links 64, a holder 90 moves parallel to itself between a standby position and a contacting position. In FIG. 5A, the holder 90 is in the standby position. In FIG. 5B, the holder 90 is in the contacting position. The holder 90 comprises a contact lever 91 that protrudes upward in the vertical direction. The holder 90 is moved to the contacting position when the carriage 40 presses the contact lever 91 rightward in FIG. 5A. The cap 46 and the exhaust cap 120 are disposed on the holder 90. When the holder 90 is moved to the contacting position, the cap 46 and the exhaust cap 120 are brought into a first state where the cap 46 and the exhaust cap 120 are in directly contact with circumferences of the nozzles 39*a* and circumferences of the exhaust holes, respectively, in the nozzle surface 39 of the recording head 38 (corresponding to a first state of the invention). When the holder 90 is moved to the standby position, the cap 46 and the exhaust cap 120 are brought into a second state where the cap 46 and the exhaust cap 120 are separated from the nozzle surface 39 of the recording head 38 (corresponding to a second state of the invention). The structure for changing the state of the cap 46 is not limited to the lifting mechanism 55 as described above. For example, the state of the cap 46 may be changed by a driving force of a motor.

A state sensor 104 (See FIG. 7) (an example of a fourth sensor of the invention) is disposed near the cap 46 to detect the state of the cap 46. The state sensor 104 comprises a slidable body and a photosensor, e.g., a photointerrupter, including a light-emitting device, e.g., a light-emitting diode, and a photoreceptor, e.g., a phototransistor. The slidable body of the state sensor 104 is slidable up and down in accordance with the change in the state of the cap 46. The photoreceptor is configured to receive light emitted from the light-emitting device. The slidable body is configured to locate in an optical path, in which light travels from the light-emitting device and the photoreceptor, to interrupt the light traveling in the optical path when the cap 46 is in the first state. The state of the cap 46 is detected based on the presence or absence of the occurrence of the interruption.

The wiper blade 56 is fitted in a wiper holder 68 and is configured to protrude and retract with respect to the wiper holder 68. The wiper blade 56 is made of, e.g., rubber. The width (a dimension in a direction perpendicular to the drawing sheet of FIG. 5A) of the wiper blade 56 is substantially the same as a width of the nozzle surface 39. When protruding from the wiper holder 68, the wiper blade 56 is in a third state where the wiper blade 56 can contact the nozzle surface 39 (corresponding to a third state of the invention). When retracting in the wiper holder 68, the wiper blade 56 is in a fourth state where the wiper blade 56 is separated from the nozzle surface 39 (corresponding to a fourth state of the invention). That is, the wiper blade 56 can change between the third state and the fourth state. The state change of the wiper blade 56 will be described below.

When the carriage 40 moves while the wiper blade 56 is in contact with the bottom surface of the recording head 38, i.e., the wiper blade 56 is in the third state, the wiper blade 56 contacts the nozzles 39*a* formed in the nozzle surface 39. The wiper blade 56 can contact an entire area of the nozzle surface 39, in which the nozzles 39*a* are formed, by the movement of the carriage 40. Thus, the wiper blade 56 wipes ink adhered to the nozzle surface 39, which is referred to as a wiping operation.

The wiper blade 56 is changed between the third state and the fourth state by the transmission of the reverse rotation force from the conveyor motor 102 by the power transmission mechanism. The wiper blade 56 is changed from the fourth state to the third state to protrude from the wiper holder 68 while the recording head 38 moves to an image recording area, after the purging operation is finished. When a rotational phase of a switching member 92 (described later) becomes a predetermined phase, the state of the wiper blade 56 is changed. That is, after the purging operation is finished, a rotary body 92A (described later) is rotated such that the switching member 92 becomes the predetermined phase.

As shown in FIG. 3, a waste ink tray 35 is disposed at a position out of the image recording area of the carriage 40 and on the opposite side of the platen 42 from the purging mechanism 44. The waste ink tray 45 is configured to receive ink to be ejected from the recording head 38 in an idle ejecting operation. The idle ejecting operation is referred to as a flushing operation. The flushing operation is performed differently from the purging operation. The flushing operation implements the maintenance, e.g., elimination of air bubbles or impure ink contained in the recording head 38. A felt is disposed in the waste ink tray 45 to absorb and hold therein the ink ejected in the flushing operation.

The port switching mechanism 121 (See FIG. 5A) is configured to change a state established between the cap 46 and the pump 124 and between the exhaust cap 120 and the waste liquid tank, between a communicated state and a non-communicated state. As shown in FIGS. 5A to 6C, the port switching mechanism 121 comprises a cover 99 having six ports 93 to 98 and the disc-shaped switching member 92 disposed inside the cover 99. The switching member 92 is rotated by the conveyor motor 102 to control connection among the ports 93 to 98 as described later. The cover 99 is made of, e.g., resin and formed in a shape of a cylinder having a bottom wall. The cover 99 has the suction port 93 formed at the substantially center of its bottom wall. The pump tube 82 is connected with the suction port 93. The pump tube 82 is connected with the waste liquid tank via the pump 124.

The other ports 94 to 98 are provided circumferentially at predetermined intervals in a side wall of the cover 99. The exhaust port 94 is in communication with the exhaust cap 120 (See FIG. 5A) via a tube (not shown). The black ink port 95 is in communication with the cap 46 (See FIG. 5A) via a tube (not shown). More specifically, the black ink port 95 is in communication with the space for black ink nozzles 39*a* formed between the cap 46 and the nozzle surface 39. The color ink port 96 is in communication with the cap 46 (See FIG. 5A) via a tube (not shown). More specifically, the color ink port 96 is in communication with the space for color ink nozzles 39*a* formed between the cap 46 and the nozzle surface 39. The atmosphere ports 97, 98 are open to the atmosphere.

Ink sucked from the recording head 38 by the maintenance unit 80 flows to the waste liquid tank as described below. Referring to FIGS. 6A to 6D, an example of a procedure of an ink suction process will be described.

When the carriage 40 moves and thus presses the contact lever 91 rightward, the holder 60 moves to the contacting position as shown in FIG. 5B. Thus, the cap 46 is in the first state where the cap 46 comes into intimate contact with the nozzle surface 39 and the spaces are formed therebetween by the lifting mechanism 55. The switching member 92 is driven and the suction port 93 and the black ink port 95 are in communication with each other (See FIG. 6B), which is referred to as a second condition. That is, the space corresponding to the black ink nozzles 39*a*, of the spaces formed between the cap 46 and the nozzle surface 39 is connected with the pump 124. In the second condition, black ink is sucked by the driving of the pump 124. That is, a negative pressure is applied to the space corresponding to the black ink nozzles 39*a*, of the spaces formed between the cap 46 and the nozzle surface 39, and the stored black ink is sucked toward the pump 124. The sucked ink is absorbed in the waste liquid tank via the pump tube 82.

Figure 6B:
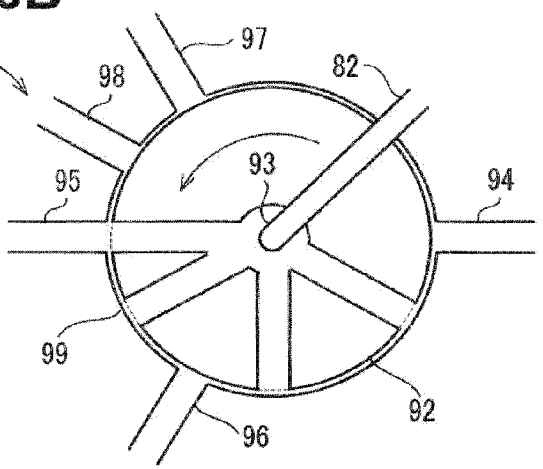
FIG. 6B is a plan view showing the port switching mechanism, wherein the suction port is in communication with a black ink port in the embodiment according to one or more aspects of the invention.
Figure 6D:
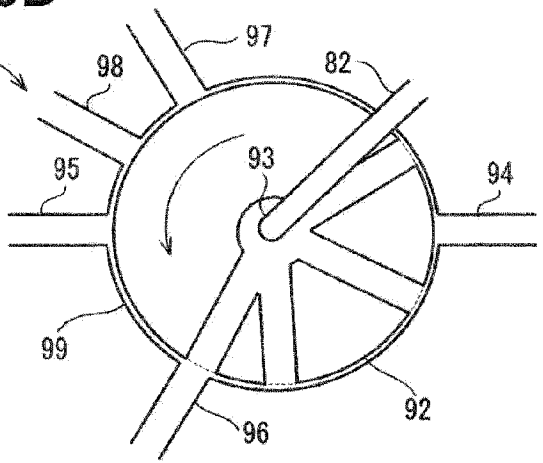
FIG. 6D is a plan view showing the port switching mechanism, wherein the suction port is in communication with a color ink port in the embodiment according to one or more aspects of the invention.
Figure 6A:
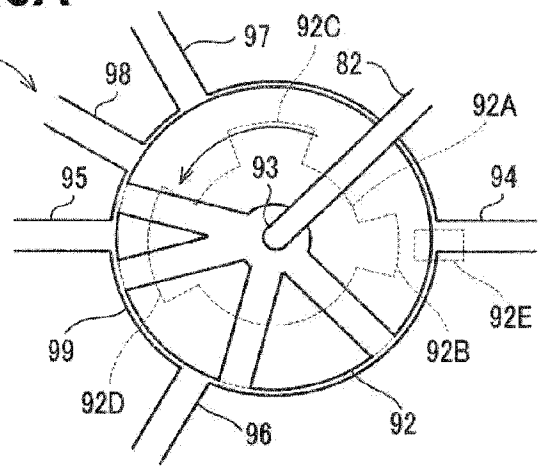
FIG. 6A is a plan view showing a port switching mechanism, wherein a suction port is not in communication with any other ports in the embodiment according to one or more aspects of the invention.
Figure 6C:
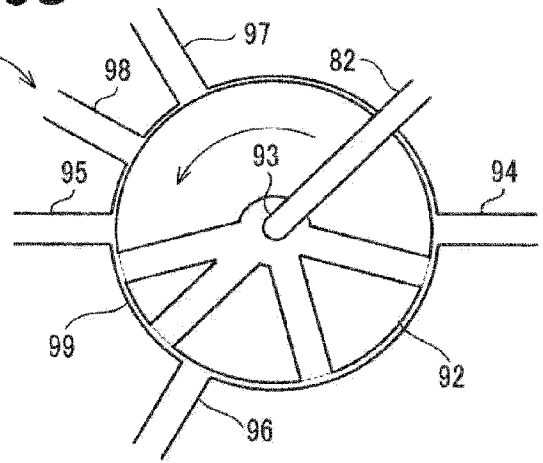
FIG. 6C is a plan view showing the port switching mechanism, wherein the suction port is not in communication with any other ports in the embodiment according to one or more aspects of the invention.

After a predetermined time (e.g., a time during which ink is sucked enough from the nozzles 39*a*) has elapsed since the ink suction started, the switching member 92 is driven and the suction port 93 is brought into a first condition in which the suction port 93 is not in communication with any of the ports 94 to 98 (See FIG. 6C). That is, the spaces formed between the cap 46 and the nozzle surface 39 are cut off from the atmosphere and are not in communication with the pump 124. Therefore, an amount of suction by the pump 124 becomes stable.

Then, the switching member 92 is driven and the suction port 93 is in communication with the color ink port 96 (See FIG. 6D), which is also referred to as the second condition similar to the condition of FIG. 6B. That is, the space corresponding to the color ink nozzles 39*a*, of the spaces formed between the cap 46 and the nozzle surface 39 is connected with the pump 124. In the second condition, color ink is sucked by the driving of the pump 124. That is, a negative pressure is applied to the space corresponding to the color ink nozzles 39*a*, of the spaces formed between the cap 46 and the nozzle surface 39, and the stored color ink is sucked toward the pump 124. The sucked ink is absorbed in the waste liquid tank via the pump tube 82.

After a predetermined time (e.g., a time during which ink is sucked enough from the nozzles 39*a*) has elapsed since the ink suction started, the switching member 92 is driven and the suction port 93 is brought into the first condition in which the suction port 93 is not in communication with any of the ports 94 to 98 (See FIG. 6C). That is, the spaces formed between the cap 46 and the nozzle surface 39 are cut off from the atmosphere and are not in communication with the pump 124. Therefore, the amount of suction by the pump 124 becomes stable.

After that, when the carriage 40 moves and is separated from the contact lever 91, the holder 90 moves to the standby position as shown in FIG. 5A. That is, the cap 46 is separated from the nozzle surface 39 and is brought into the second state by the lifting mechanism 55.

When the suction port 93 is brought into the second condition by the driving of the switching member 92 and the pump 124 is driven while the cap 46 is in the second state, the idle ejecting operation is performed to clean up the interior of the cap 46. That is, ink is not sucked from the nozzles 39*a* although the pump 124 is driven, because the cap 46 is separated from the nozzle surface 39. The idle ejecting operation is performed while the suction port 93 is in communication with the black ink port 95 or the color ink port 96.

As shown in FIG. 6A, the switching member 92 comprises a rotary body 92A (shown by a dashed line in FIG. 6A) disposed at an upper portion or a lower portion of the switching member 92. The rotary body 92A rotates integrally with the switching member 92. The rotary body 92A comprises protrusions 92B, 92C, 92D that protrude outward in a radial direction. The protrusions 92B, 92C, 92D are provided in respective positions of different phases in a rotational direction of the rotary body 92A. The protrusions 92B, 92C, 92D are disposed to be apart from each other by a predetermined rotation angle. A sensor 92E is disposed to face an outer edge of the rotary body 92A. The sensor 92E outputs an electric signal of "on" when facing one of the projections 92B, 92C, 92D, and the sensor 92E outputs an electric signal of "off" when not facing any of the projections 92B, 92C, 92D. The rotational phase of the switching member 92 is grasped based on a periodical change of the output (on/off) from the sensor 92E.

In addition to the purging operation and the idle ejecting operation, an air exhaust operation and the wiping operation are performed at predetermined timings. The air exhaust operation is performed by establishing communication between the suction port 93 and the exhaust port 94 by the switching member 92. The wiping operation is performed at a timing at which the switching member 92 becomes a predetermined phase while the cap 46 is in the second state. That is, the wiper blade 56 is changed between the third state and the fourth state by the reverse rotation force transmitted from the conveyor motor 102 by the power transmission mechanism. In this state, the recording head 38 is moved and ink adhered to the nozzle surface 39 is wiped off.

An overall configuration of a controller 130 (an example of a control section of the invention) will be described with reference to FIG. 7. The invention can be implemented by which the controller 130 performs control for discharging the media tray 71 in accordance with flowcharts described below.

The controller 130 is adapted to control overall operations of the multifunction device 10. The controller 130 is configured as a microcomputer that comprises a central processing unit (CPU) 131, a read-only memory (ROM) 132, a random-access memory (RAM) 133 (an example of a storage of the invention), an electrically erasable programmable ROM (EEPROM) 134, and an application-specific integrated circuit (ASIC) 135, which are connected via an internal bus 137.

The ROM 132 is configured to store programs for the CPU 131 to control various operations of the multifunction device 10. The RAM 133 is employed as a storage area for temporarily storing data or signals to be used for the CPU 131 to execute the programs, or as a workspace for data processing by the CPU 131. The EEPROM 134 is configured to store settings and flags that are to be held after the multifunction device 10 is powered off.

The program according to the embodiment is a cleaning execution program for controlling a cleaning operation performed by the maintenance unit 80. The cleaning operation includes the purging operation, the wiping operation, and the flushing operation. Procedures of operations to be performed in the cleaning operation, e.g., the changing of the cap position, the movement of the carriage, the suction, an idle suction, the air exhaust, the wiping, and the flushing, are written in the cleaning execution program. Instructions to be provided to each motor 101, 102, 103 to drive the pump 124, the port switching mechanism 121, the carriage 40, and the cap 46, are also written in the cleaning execution program. In addition, timings at which data to be received from the state sensor 104, the photosensor 111 or the rotary encoder 122, and details of processing in which the received data is to be used, are written in the cleaning execution program. The procedure of the cleaning operation written in the cleaning execution program corresponds to a predetermined procedure of the invention. The controller 130 operates the recording portion 24 and the cap 46 and drives the conveyor motor 102 in the forward and reverse directions in accordance with the cleaning execution program. By doing so, the controller 130 controls the cleaning operation of the recording head 38 by controlling the pump 124 and the port switching mechanism 121.

The ASIC 135 is connected with the motors 101, 102, 103, the position sensor 77, the state sensor 104, the photosensor 111, and the rotary encoder 122.

The ASIC 135 comprises a drive circuit incorporated therein for controlling the motors 101, 102, 103. When a drive signal for rotating a predetermined motor is inputted to the drive circuit from the CPU 131, a drive current responsive to the drive signal is outputted to the predetermined motor from the drive circuit. Accordingly, the predetermined motor is driven at predetermined rotational speed in one of the forward direction and the reverse direction. The sheet feed roller 25 is rotated by one of the forward rotation and the reverse rotation of the sheet feed motor 101, and the eccentric cam 150 is rotated by another of the forward rotation and the reverse rotation of the sheet feed motor 101. The rotation of the conveyor motor 102 in the forward and reverse directions is transmitted to the first conveyor roller 60, the second conveyor roller 62, the port switching mechanism 121, the pump 124, and the wiper blade 56 by the power transmission mechanism. The carriage 40 slides in the right-left direction 9 by the driving of the carriage drive motor 103.

The position sensor 77 outputs an analog electric signal (an electric voltage signal or an electric current signal) responsive to an intensity of light received by the photoreceptor. The output signal is inputted into the controller 130. The controller 130 determines whether an electric level (an electric voltage value or an electric current value) of the signal is higher than or equal to a predetermined threshold value. For example, when the signal is higher than or equal to the predetermined threshold value, the controller 130 determines that the tray guide 76 is in the second position. When the signal is lower than the predetermined threshold value, the controller 130 determines that the tray guide 76 is not in the second position.

The state sensor 104 and the photosensor 111 output analog electric signals (an electric voltage signal or an electric current signal) responsive to an intensity of light received by the photoreceptor. The output signal is inputted into the controller 130. The controller 130 determines whether an electric level (an electric voltage value or an electric current value) of the signal is higher than or equal to a predetermined threshold value. For example, when the signal is higher than or equal to the predetermined threshold value, the controller 130 determines that the signal is a HIGH-level signal. When the signal is lower than the predetermined threshold value, the controller 130 determines that the signal is a LOW-level signal. By those determinations, the controller 130 determines the state of the cap 46 and the presence or absence of the media tray 71 at the sheet sensor 110.

Pulse signals generated by the photosensor of the rotary encoder 122 is inputted into the controller 130. As described above, the controller 130 calculates a driving amount of the conveyor motor 102 based on the pulse signals received from the photosensor.

Figure 8A:
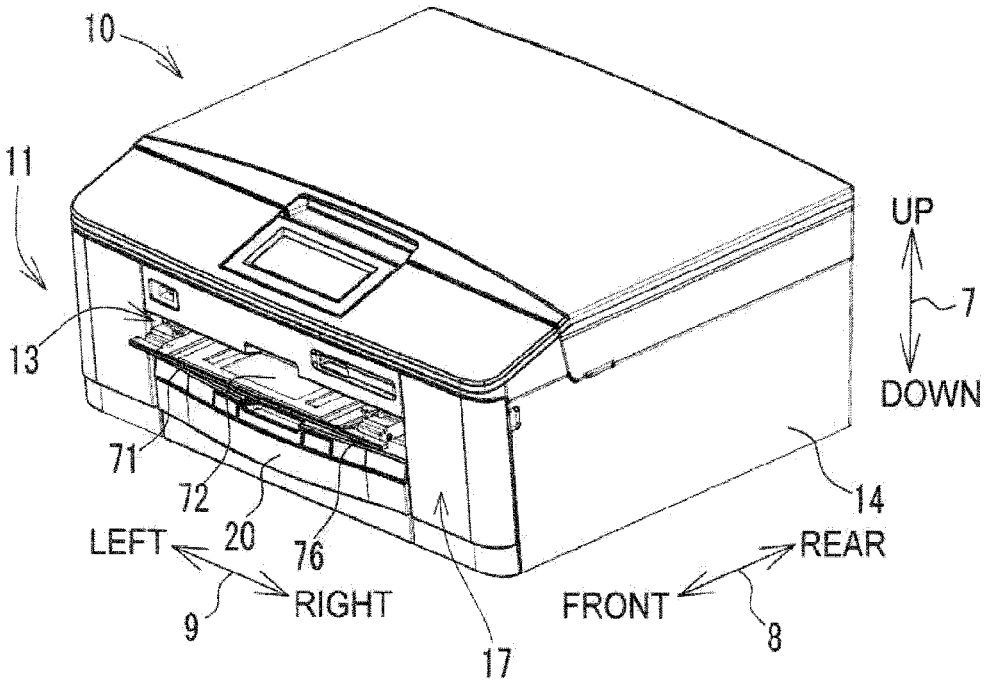
FIG. 8A is a perspective view showing the multifunction device, wherein a media tray is inserted into the multifunction device through a front opening of the multifunction device in the embodiment according to one or more aspects of the invention.

Hereinafter, a procedure of inserting the media tray 71 into the multifunction device 10 and recording an image onto a surface of a recording medium 69 placed on the media tray 71 will be described. As shown in FIGS. 2 and 8A, when the tray guide 76 is moved from the second position to the first position by a user's operation, the eccentric cam 140 rotates in synchronization with the movement of the tray guide 76. Thus, the second conveyor roller 62 is changed from the contacting state to the separated state and the platen 42 is moved from the upper position to the lower position. Then, the media tray 71, on which the recording medium 69 is placed, is placed on the tray guide 76 such that the media tray 71 is supported by the tray guide 76. At that time, the media tray 71 is set on the tray guide 76 with its leading edge contacting the second roller pair 59.

Next, when a function of recording an image onto a surface of a recording medium 69 through an operation of an operating panel 18 (See FIG. 1) disposed on an upper front portion of the multifunction device 10, the sheet feed motor 101 is driven to rotate the eccentric cam 150. Therefore, the pinch roller 61 is changed from the contacting state to the separated state.

After that, when an instruction for recording an image onto a surface of a recording medium 69 is issued through the operation of the operating panel 18, the first conveyor roller 60 and the second conveyor roller 62 are rotated in the reverse direction. Thus, the media tray 71 is conveyed in the second direction 6 by the second roller pair 59. The media tray 71 being conveyed passes under the recording portion 24 and is then pinched by the first roller pair 58 in the downstream of the second direction 6.

Figure 8B:
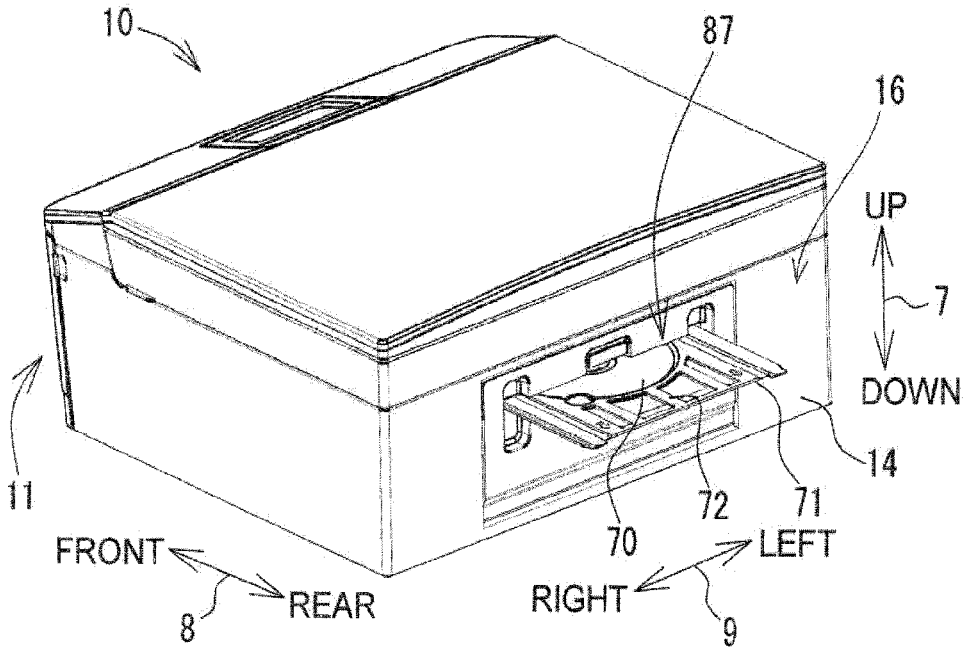
FIG. 8B is a perspective view showing the multifunction device, wherein the media tray protrudes from a rear opening of the multifunction device in the embodiment according to one or more aspects of the invention.

Then, the media tray 71 pinched by the roller pairs 58 and 59 is further conveyed in the second direction 6 and thus protrudes from the multifunction device 10 through the rear opening 87 as shown in FIG. 8B.

In this state, the rotating direction of the first conveyor roller 60 and the second conveyor roller 62 is changed from the reverse direction to the forward direction. Therefore, the media tray 71 is conveyed in the first direction 5 and the recording medium 69 placed on the media tray 71 passes under the recording portion 24. While the recording medium 69 passes under the recording portion 24, ink droplets are ejected from the recording head 38 onto the recording medium 69. Therefore, an image is recorded onto the surface of the recording medium 69. After that, the media tray 71 is discharged to the outside of the multifunction device 10 via the front opening 13.

In the printing portion 11 configured as described above, the controller 130 is configured to perform control for discharging the media tray 71 when the media tray 71 is inserted into the multifunction device 10 in the process of performing the cleaning operation by the maintenance unit 80. A control procedure of a media tray discharging process will be described with reference to FIG. 9. The control of the media tray discharging process is performed when the cleaning operation is instructed by the user's operation through the operating panel 18 of the multifunction device 10, for example.

In the embodiment and variations (described later), a procedure of the cleaning operation written in the cleaning execution program is defined as described below. The cleaning operation procedure described below is one of examples of the invention, therefore, the cleaning operation procedure may be changed. In the cleaning operation procedure, the driving of the switching member 92 to make the amount of suction by the pump 124 be stable, i.e., the driving of the switching member 92 to not establish communication between the suction port 93 and the other ports 94 to 98, will be omitted. The flushing operation will be also omitted from the cleaning operation procedure.

The cleaning operation procedure according to the embodiment and variations (described later) will be described below. An initial state of the cap 46 is in the first state where the cap 46 covers the nozzle surface 39. In a first process, the switching member 92 is driven to establish communication between the suction port 93 and the black ink port 95. In a second process, the pump 124 is driven to suck black ink. In a third process, the switching member 92 is driven to establish communication between the suction port 93 and the color ink port 96. In a fourth process, the pump 124 is driven to suck color ink. In a fifth process, the switching member 92 is driven to establish communication between the suction port 93 and the exhaust port 94 to exhaust air. In a sixth process, the cap 46 is changed from the first state to the second state where the cap 46 is separated from the nozzle surface 39. In a seventh process, the switching member 92 is driven to establish communication between the suction port 93 and the black ink port 95. In an eighth process, the pump 124 is driven to idly suck black ink. In a ninth process, the wiping operation is performed. That is, the wiper blade 56 is changed from the fourth state to the third state to protrude from the wiper holder 68, and the recording head 38 is moved by the movement of the carriage 40. Then, the wiper blade 56 is changed from the third state to the fourth state to retract in the wiper holder 68. In a tenth process, the switching member 92 is driven to establish communication between the suction port 93 and the color ink port 96. In an eleventh process, the pump 124 is driven to idly suck color ink. In a twelfth process, the cap 46 is changed from the second state to the first state.

Table 1 illustrates a summary table for the cleaning process described herein. Column 1 shows the process (steps/stages). Column 2 shows the functions or operations performed during the each process. Column 3 shows the direction of rotation of the first drive source that is required to perform each process. Column 4 shows the direction of rotation of the first conveyor portion that also rotates due to the rotation of the first drive source.

TABLE 1 i.

| Process | Operation | First drive source 102 | First conveyer portion59 |
|---|---|---|---|
| Initial state | The cap 46 is in the first state where the cap 46 covers the nozzle surface 39 | No rotation | No rotation |
| First process | Switching member 92 is driven establish communication between the suction port 93 and the black ink port 95 | Reverse direction of rotation | Second direction (the tray is drawn into the inkjet printer) |
| Second process | The pump 124 is driven to suck black ink | Forward direction of ratation | First direction (the tray is discharged out of the inkjet printer) |
| Third process | Switching member 92 is driven establish communication between the suction port 93 and the color ink port 96 | Reverse direction of rotation | Second direction (the tray is drawn into the inkjet printer) |
| Fourth process | The pump 124 is driven to suck color ink | Forward direction of ratation | First direction (the tray is discharged out of the inkjet printer) |
| Fifth process | Switching member 92 is driven establish communication between the suction port 93 and the exhaust port 94 to exhaust air | Reverse direction of rotation | Second direction (the tray is drawn into the inkjet printer) |
| Sixth process | The cap 46 is changed from the first state to the second state where the cap 46 is separated from the nozzle surface 39 (use lifting mechanism or another motor) | No rotation | No rotation |
| Seventh process | Switching member 92 is driven establish communication between the suction port 93 and the black ink port 95 | Reverse direction of rotation | Second direction (the tray is drawn into the inkjet printer) |
| Eighth process | The pump 124 is driven to idly suck black ink | Forward direction of rotation | First direction (the tray is discharged out of the inkjet printer) |
| Ninth process | The wiping operation is performed. (the wiper blade 56 is changed from the fourth state to the third state to protrude from the wiper holder 68) | Reverse direction of rotation | Second direction (the tray is drawn into the inkjet printer) |
| Tenth process | Switching member 92 is driven establish communication between the suction port 93 and the color ink port 96 | Reverse direction of rotation | Second direction (the tray is drawn into the inkjet printer) |
| Eleventh process | The pump 124 is driven to idly suck color ink | Forward direction of ratation | First direction (the tray is discharged out of the inkjet printe ) |
| Twelfth process | The cap 46 is changed from the second state to the first state | No rotation | No rotation |

The controller 130 controls the conveyor motor 102 to rotate in the forward direction on the condition that the position sensor 77 detects that the tray guide 76 is not in the second position during the cleaning operation, as described later in steps SA2, SA6, SA7, SA9, SA10, SA12, SA13, and SA16 of FIG. 9. The controller 130 stores, in the RAM 133, an unperformed process, which has not been performed yet, in the cleaning operation procedure, when the position sensor 77 detects that the tray guide 76 is not in the second position during the cleaning operation, as described later in steps SA2, SA7, SA10, SA13, SA21, SA22 and SA23 of FIG. 9. The controller 130 performs the unperformed process, which is stored in the RAM 133, and subsequent processes on the condition that the position sensor 77 detects that the tray guide 76 is in the second position after the controller 130 controls the conveyor motor 102 to rotate in the forward direction, as described later in steps SA18 and SA19 of FIG. 9.

Upon an issue of an instruction to perform the cleaning operation of the recording head 38 by the user's operation through the operating panel 18 of the multifunction device 10, the cleaning operation starts (SA1, hereinafter, S stands for a step). The controller 130 determines whether the tray guide 76 is in the second position based on a signal inputted from the position sensor 77 (SA2). When detecting that the tray guide 76 is in the second position (SA2:YES), the controller 130 runs the cleaning execution program. Thus, the controller 130 performs the processing of SA3 and the subsequent steps.

When detecting that the tray guide 76 is not in the second position (SA2:NO), the controller 130 stores, in the RAM 133, information about an unperformed process in the cleaning operation procedure based on the cleaning execution program (SA21). At the time when the controller 130 made the determination in SA2, the cleaning execution program has not started yet. Therefore, the controller 130 allocates, in the RAM 133, an unperformed process storage area in which a process to be performed next (the next process) is stored, and stores, in the unperformed process storage space, information indicating that the next process is the first process.

After SA21, the controller 130 drives the carriage drive motor 103 to move the carriage 40 such that the holder 90 is changed from the contacting position to the standby position and the cap 46 is changed from the first state to the second state (SA5). Then, the controller 130 drives the conveyor motor 102 in the forward direction (SA6). By doing so, the second conveyor roller 62 rotates in the direction that conveys the media tray 71 in the first direction 5. Thus, when the media tray 71 is placed on the tray guide 76 in the second position, the media tray 71 is not drawn into the inside of the multifunction device 10 along the straight path 65.

A first predetermined driving amount is set to the driving amount of the conveyor motor 102 in the forward direction in SA6. For example, the first predetermined driving amount of the conveyor motor 102 is an amount enough to reverse the media tray 71, which is placed on the tray guide 76, in the first direction 5 by the second roller pair 59 and separate the media tray 71 from the second roller pair 59. When the media tray 71 is separated from the second roller pair 59, the media tray 71 is not drawn into the inside of the multifunction device 10 by the second roller pair 59.

After SA6, the controller 130 moves the carriage 40 to change the cap 46 from the second state to the first state (SA17) and then stays on standby until the controller 130 determines that the tray guide 76 is in the second position (SA18:NO). When determining that the tray guide 76 is in the second position (SA18:YES), the controller 130 refers to the unperformed process storage area of the RAM 133 and performs the cleaning operation in accordance with the cleaning operation procedure, starting with the process corresponding to the information stored in the unperformed process storage area (SA19). When the controller 130 determines that the tray guide 76 is not in the second position in SA2, the information indicating that the next process is the first process is stored in the unperformed process storage area. Therefore, the controller 130 performs the cleaning operation in accordance with the cleaning operation procedure, starting with the first process (SA19). When all of the first to the twelfth processes of the cleaning operation have been implemented, the cleaning operation is finished (SA20).

As illustrated in FIG. 9 and described above, after controller 130 moves the carriage 40 to change the cap 46 from the second state to the first state (SA17), the controller 130 remains in a standby state until the controller 130 determines that the tray guide 76 is in the second position (SA18:YES). However, in another embodiment, the controller 130 can perform the cleaning operation in accordance with the cleaning operation procedure, starting with the process corresponding to the information stored in the unperformed process storage area (SA19), without determining the state of the tray guide 76. This is because it is unlikely that the media tray 71 would be brought back into an area where the media tray 71 will collide with an object, since the conveyor motor 102 has rotated the first conveyer roller 60 in the forward direction by the first predetermined amount. Thus, the media tray 71 is downstream from the first conveyor roller 60 and separate therefrom.

Subsequently, if the media tray 71 is accidently moved in contact with the first conveyor roller 60 and the media tray 71 is conveyed in the reverse direction, the cleaning process can be interrupted to convey the media tray 71 in the forward direction, if a position sensor 77 outputs a signal indicating a detection of the media tray 71. The media tray 71 can be conveyed in the forward direction using the first predetermined driving amount in a similar manner as any of SA6, SA9, SA12 and SA16 (depending on the current process of the cleaning operation)

When determining that the tray guide 76 is in the second position in SA2 (SA2:YES), the controller 130 performs the suction of ink adhered to the recording head 38 and the air exhaust (SA3). More specifically, the controller 130 performs the first process to the fifth process of the cleaning operation procedure. Then, the controller 130 performs the sixth process and the seventh process (SA4). The controller 130 drives the conveyor motor 102 to actuate the switching member 92 of the port switching mechanism 121 to establish communication between the suction port 93 and the black ink port 95 with each other (SA4).

Then, the controller 130 determines whether the tray guide 76 is in the second position (SA7). When determining that the tray guide 76 is in the second position (SA7:YES), the controller 130 performs the processing of SA8 and the subsequent steps.

When determining that the tray guide 76 is not in the second position (SA7:NO), the controller 130 stores information indicating that the next process is the eighth process, in the unperformed process storage area of the RAM 133 (SA22). The controller 130 rotates the conveyor motor 102 in the forward direction (SA9). Thus, the second conveyor roller 62 rotates in the direction that conveys the media tray 71 in the first direction 5. The driving amount of the conveyor motor 102 in the forward rotation is, for example, the same as that in SA6. After that, the controller 130 performs the processing of SA17 to SA20.

When determining that the tray guide 76 is in the second position (SA7:YES), the controller 130 actuates the pump 124 to perform the idle suction (SA8). More specifically, the controller 130 performs the eighth process of the cleaning operation procedure.

After the idle suction, the controller 130 determines whether the tray guide 76 is in the second position (SA10). When determining that the tray guide 76 is in the second position (SA10:YES), the controller 130 performs the processing of SA11 and the subsequent steps.

When determining that the tray guide 76 is not in the second position (SA10:NO), the controller 130 stores, in the unperformed process storage area of the RAM 133, information indicating that the next process is the ninth process (SA23). The controller 130 rotates the conveyor motor 102 in the forward direction (SA12). Thus, the second conveyor roller 62 rotates in the direction that conveys the media tray 72 in the first direction 5. The driving amount of the conveyor motor 102 in the forward rotation is the same as that in SA6. Then, the controller 103 performs the processing of SA17 to SA20.

When determining that the tray guide 76 is in the second position in SA10 (SA10:YES), the controller 130 performs the wiping operation and the switching of the port communication (SA11). More specifically, the controller 130 performs the ninth process and the tenth process of the cleaning operation procedure.

After performing the switching of the port communication (the tenth process), the controller 130 determines whether the tray guide 76 is in the second position (SA13). When determining that the tray guide 76 is in the second position (SA13: YES), the controller 130 performs the processing of SA14 and the subsequent steps.

When determining that the tray guide 76 is not in the second position (SA13:NO), the controller 130 stores, in the unperformed process storage area of the RAM 133, information indicating that the next process is the eleventh process (SA24). The controller 130 rotates the conveyor motor 102 in the forward direction (SA16). Thus, the second conveyor roller 62 rotates in the direction that conveys the media tray 71 in the first direction 5. The driving amount of the conveyor motor 102 in the forward rotation is the same as that in SA6. After that, the controller 130 performs the processing of SA17 to SA20.

When determining that the tray guide 76 is in the second position (SA13:YES), the controller 130 actuates the pump 124 to perform the idle suction similar to SA8 (SA14). More specifically, the controller 130 performs the eleventh process of the cleaning operation procedure.

After that, the controller 130 moves the carriage 40 to change the cap 46 from the second state to the first state (SA15). More specifically, the controller 130 performs the twelfth process of the cleaning operation procedure. When all of the first to the twelfth processes have been implemented, the cleaning operation is finished (SA20).

In the processing of the flowchart of FIG. 9, the first predetermined driving amount is set to the driving amount of the conveyor motor 102 in the forward direction in SA6, SA9, SA12 and SA16.

The driving of the conveyor motor 102 in the forward direction in SA6, SA9, SA12 and SA16 may be continued until the controller 130 determines that the tray guide 76 is in the second position. In this case, the performance order of SA17 and SA18 are switched in the cleaning operation procedure. That is, when the controller 130 determines that the tray guide 76 is in the second position (SA18:YES), the driving of the conveyor motor 102 in the forward direction is stopped and then the controller 130 changes the cap 46 from the second state to the first state (SA17).

When the position sensor 77 detects that the tray guide 76 is not in the second position during the cleaning operation of the recording head 38, the media tray 71 may be supported by the tray guide 76 such that the tray guide 76 allows the media tray 71 to enter the straight path 65. In this case, if the media tray 71 is conveyed by the second roller pair 59 in the second direction 6, the media tray 71 may be drawn into the inside of the multifunction device 10. According to the embodiment, the controller 130 rotates the conveyor motor 102 in the forward direction when such a situation occurs. With this control, the media tray 71 is conveyed in the first direction 5 by the second roller pair 59 although the media tray 71 is supported by the tray guide 76. Accordingly, the media tray 71 can be prevented from being drawn behind the second roller pair 59 in the front-rear direction 8. Thus, the media tray 71 can be prevented from hitting against an object during the cleaning operation of the recording head 38 although the media tray 71 is inserted into the multifunction device 10.

According to the embodiment, the controller 130 restarts the cleaning operation on the condition that the tray guide 76 is in the second position. That is, the controller 130 can start the cleaning operation again after the tray guide 76 does not allow the media tray 71 to enter the straight path 65.

According to the embodiment, the recording portion 24 moves in the right-left direction 9 while the wiper blade 56 is in contact with the nozzle surface 39. Therefore, ink adhered to the nozzle surface 39 can be wiped by the wiper blade 56.

A control procedure of a media tray discharging process according to a first variation will be described with reference to FIG. 10.

The controller 130 may rotate the conveyor motor 102 in the forward direction on the condition that a driving amount of the conveyor motor 102 in the reverse direction is greater than or equal to a second predetermined amount in the cleaning operation procedure under a condition where the position sensor 77 has detected that the tray guide 76 is not in the second position, as described later in SB9 and SB14 of FIG. 10. The controller 130 rotate the conveyor motor 102 in the forward direction on the further condition that the state sensor 104 has detected that the cap 46 is in the second state, as described later in SB 12 and SB13 of FIG. 10.

Some of processing included in the flowchart of FIG. 10 are similar to those included in the flowchart of FIG. 9, and therefore, a description for the similar processing will be omitted.

The processing of SB1 to SB3, SB5, SB6, and SB17 to SB22 of FIG. 10 are similar to those of SA1 to SA3, SA5, SA6, and SA17 to SA22 of FIG. 9, respectively.

After SB3, the controller 130 performs the sixth process of the cleaning operation procedure. That is, the controller 130 moves the carriage 40 to change the cap 46 from the first state to the second state (SB4).

Next, the controller 130 determines whether the tray guide 76 is in the second position (SB7). When determining that the tray guide 76 is in the second position (SB7:YES), the controller 130 performs the processing of SB10 and the processing of the subsequent steps, i.e., continues performing the cleaning operation. More specifically, the controller 130 performs the seventh process and the subsequent processes of the cleaning operation procedure.

When determining that the tray guide 76 is not in the second position (SA7:NO), the controller 130 determines the rotational direction of the conveyor motor 102 in the next process in accordance with the cleaning operation procedure (SB8). That is, the controller 130 determines whether, in the next process, the conveyor motor 102 is to be driven in the forward direction or in the reverse direction, or is not to be driven (the process, in which the conveyor motor 102 is not driven, e.g., the changing of the state of the cap 46, is to be performed). When the conveyor motor 102 is not to be driven in the reverse direction (SB8:NO), the cleaning operation is continued (SB10) because the media tray 71 will not be drawn into the multifunction device 10.

When the conveyor motor 102 is to be driven in the reverse direction (SB8:YES), the controller 130 determines whether the driving amount of the conveyor motor 102 in the reverse direction in the next process is to be greater than or equal to the second predetermined amount based on a pulse signal from the photosensor of the rotary encoder 122 (SB9).

The second predetermined amount is the driving amount of the conveyor motor 120 that is required for conveying the media tray 71 in the second direction 6 from the second roller pair 59 to an object against which the leading edge of the media tray 71 may hit. The object may be, for example, the first roller pair 58 comprising the rollers 60, 61 that are in contact with each other, the frame of the multifunction device 10 disposed at a position that the media tray 71 may pass, the rear wall 16 (See FIGS. 2 and 8) of the multifunction device 10 that does not have the rear opening 87, the outer guide member 22 (a portion shown by a dashed line in FIG. 2) when the second path 65B is not provided, and a wall of a room in which the multifunction device 10 is installed (more specifically, a room wall facing the rear wall 16 of the multifunction device 10).

As shown in FIG. 2, in a case where the object is the first roller pair 58, the second predetermined amount is the driving amount of the conveyor motor 102 that is required for conveying the media tray 71 in the second direction 6 for a distance A. In a case where the object is the rear wall 16 of the multifunction device 10 or the room wall, the second predetermined amount is the driving amount of the conveyor motor 102 that is required for conveying the media tray 71 in the second direction 6 for a distance B1. In a case where the object is the outer guide member 22, the second predetermined amount is the driving amount of the conveyor motor 102 that is required for conveying the media tray 71 in the second direction 6 for a distance B2.

When the amount of the conveyor motor 102 in the reverse direction in the next process is to be smaller than the second predetermined amount (SB9:NO), the controller 130 determines that there is no possibility that the media tray 71 will hit against the object in the multifunction device 10 without driving the conveyor motor 102 in the forward direction. Accordingly, the cleaning operation is continued (SB10). When the driving amount of the conveyor motor 102 in the reverse direction in the next process is to be greater than or equal to the second predetermined amount (SB9:YES), the controller 130 stores, in the RAM 133, information about an unperformed process in the cleaning operation procedure based on the cleaning execution program (SB22). The controller 130 determines whether the cap 46 is in the first state based on an input signal from the state sensor 104 (SB12). When determining that the cap 46 is in the first state (SB12: YES), the controller 130 changes the cap 46 from the first state to the second state (SB13) and then drives the conveyor motor 102 in the forward direction (SB14). When determining that the cap 46 is in the second state (SB12:NO), the controller 130 drives the conveyor motor 102 in the forward direction (SB14) without changing the state of the cap 46. That is, the controller 130 drives the conveyor motor 102 in the forward direction on the condition that the controller 130 determined that the cap 46 is in the second state.

In the embodiment, after the cap 46 is changed to the second state in the sixth process, the state of the cap 46 is not changed until the time when the twelfth process is performed. Therefore, the cap 46 is always in the second state in SB12. As described above, however, the cleaning operation procedure according to the embodiment is one of examples of the invention. There may be a case where the cap 46 is in the first state in SB12.

By the rotation of the conveyor motor 102 in the forward direction, the second conveyor roller 62 rotates in the direction that conveys the media tray 71 in the first direction 5. A first predetermined driving amount is set to the driving amount of the conveyor motor 102 in the forward direction in SB14. For example, the first predetermined driving amount of the conveyor motor 102 is an amount enough to reverse the media tray 71, which is placed on the tray guide 76, in the first direction 5 by the second roller pair 59, convey the media tray 71 toward the front than the second roller pair 59 in the front-rear direction 8, and separate the media tray 71 from the second roller pair 59. If the media tray 71 is separated from the second roller pair 59 in front thereof, the media tray 71 is not drawn into the inside of the multifunction device 10 by the second roller pair 59.

After SB14, the controller 130 performs the processing of SB17 to SB19.

Processing of SB7 to SB10, and SB12 to SB19 are repeated until all processes of the cleaning operation have been performed (SB11). When all of the first to the twelfth processes have been performed, the cleaning operation is finished (SB20).

In the first variation, the cleaning operation is stopped while the controller 130 rotates the conveyor motor 102 in the forward direction during the cleaning operation in SB6 and SB14. However, it is undesirable to stop the cleaning operation in progress. While the cleaning operation is stopped, ink remains on the nozzle surface 39 of the recording head 38 or in the cap 46. This may cause the mixture of ink of different colors or an ink stain on other portions of the inside of the multifunction device 10. In addition, the time required for completing the cleaning operation may be elongated.

In the first variation, the rotation of the conveyor motor 102 in the forward direction by the controller 130 during the cleaning operation can be minimized as described below. If the conveyor motor 102 is rotated in the reverse direction while the media tray 71 is supported by the tray guide 76 located in the first position, the media tray 71 is conveyed in the second direction 6 and is drawn into the multifunction device 10. However, when the driving amount of the conveyor motor 102 in the reverse direction in the next process is, for example, smaller than the second predetermined amount, the media tray 71 is to be conveyed for a short distance in the second direction 6, so that there is a less possibility that the media tray 71 will hit against an object existing on the side in the direction that the media tray 71 proceeds. When the driving amount of the conveyor motor 102 in the reverse direction in the next process is, for example, greater than or equal to the second predetermined amount, the media tray 71 is to be conveyed for a long distance in the second direction 6, so that there is a high possibility that the media tray 71 will hit against the object. According to the first variation, the conveyor motor 102 is rotated in the forward direction only when the driving amount of the conveyor motor 102 in the reverse direction in the next process is greater than or equal to the second predetermined amount, i.e., when there is a high possibility that the media tray 71 will hit against the object. That is, the driving of the conveyor motor 102 in the forward direction can be minimized and the interruptions of the cleaning operation can be minimized.

In the first variation, when the conveyor motor 102 is rotated in the forward direction, the forward rotation force is transmitted to the pump 124 by the power transmission mechanism, thereby actuating the pump 124. When the pump 124 is actuated while the cap 46 is in the first state, ink is sucked from the recording head 38 via the cap 46. As a result, ink is wasted. According to the first variation, the controller 130 rotates the conveyor motor 102 in the forward direction on the condition that the cap 46 is in the second state. By doing so, ink is not sucked from the recording head 38 by the pump 124 although the pump 124 is actuated because the cap 46 is in the second state. Accordingly, ink is prevented from being wasted.

A control procedure of a media tray discharging process according to a second variation will be described with reference to FIG. 11.

The controller 130 may rotate the conveyor motor 102 in the forward direction under a condition where the position sensor 77 has detected that the tray guide 67 is not in the second position, based on the driving amount of the conveyor motor 102 in the reverse direction in the cleaning operation, and more specifically, on the condition that a difference between a total driving amount of the conveyor motor 102 in the forward direction in the cleaning operation procedure and a total driving amount of the conveyor motor 102 in the reverse direction in the cleaning operation procedure is greater than or equal to a third predetermined amount, as described later in SC8, SC11, SC14 and SC18 of FIG. 11.

Some of processing included in the flowchart of FIG. 11 are similar to those included in the flowcharts of FIGS. 9 and 10, and therefore, a description for the similar processing will be omitted.

The processing of SC1 to SC7, SC12 and SC13, SC16 and SC17 of FIG. 11 are similar to those of SB1 to SB7, SB12 and SB13, SB21 and SB22 of FIG. 10, respectively. The processing of SC15 and SC19 to SC21 are similar to those of SB14, SB17 to SB19 of FIG. 10, respectively. The processing of SC22 of FIG. 11 is similar to that of SB10 of FIG. 10.

When the controller 130 determines that the tray guide 76 is in the second position in SC7 (SC7:YES), the cleaning operation is continued (SC22). When determining that the tray guide 76 is not in the second position (SC7:NO), the controller 130 determines the rotational direction of the conveyor motor 102 in the next process in accordance with the cleaning operation procedure (SC8). That is, the controller 130 determines whether the conveyor motor 102 is to be driven in the reverse direction in the next process.

When the controller 130 determines that the conveyor motor 102 is not be driven in the reverse direction in the next process (SC8:NO), the cleaning operation is continued (SC22). When determining that the conveyor motor 102 is to be driven in the reverse direction in the next process (SC8: YES), the controller 130 determines whether the sum of the current driving amount of the conveyor motor 102 in the reverse direction and a cumulative driving amount of the conveyor motor 102 is greater than or equal to the third predetermined amount (SC11).

The third predetermined amount is the same as that specified in the second predetermined amount. The cumulative driving amount of the conveyor motor 102 is a total of the driving amount of the conveyor motor 102 in each process of the cleaning operation procedure (for example, the forward rotation is a plus value and the reverse rotation is a minus value). That is, the cumulative driving amount of the conveyor motor 102 is a difference between the total driving amount of the conveyor motor 102 in the forward direction in the cleaning operation procedure and the total driving amount of the conveyor motor 102 in the reverse direction in the cleaning operation procedure. The cumulative driving amount of the conveyor motor 102 is added unless being reset in SC18.

When determining that the sum of the current driving amount of the conveyor motor 102 in the reverse direction and the cumulative drive amount of the conveyor motor 102 is smaller than the third predetermined amount (SC11:NO), the controller 130 determines that there is no possibility that the media tray 71 will hit against the object in the multifunction device 10 without rotating the conveyor motor 102 in the forward direction. Therefore, the controller 130 obtains an updated cumulative driving amount of the conveyor motor 102 by adding the current driving amount of the conveyor motor 102 in the reverse direction to the existing cumulative driving amount of the conveyor motor (SC14) and continues the cleaning operation (SC22).

When determining that the sum of the current driving amount of the conveyor motor 102 in the reverse direction and the cumulative drive amount of the conveyor motor 102 is greater than or equal to the third predetermined amount (SC11:YES), the controller 130 stores, in the RAM 133, information about an unperformed process in the cleaning operation procedure based on the cleaning execution program (SC17). The controller 130 performs the processing of SC12 and the subsequent steps. The controller 130 resets the cumulative driving amount of the conveyor motor 102 to 0 (zero) in SC18.

Processing of SC7 to SC22 are repeated until all processes of the cleaning operation have been performed (SC23). When all of the first to the twelfth processes have been performed, the cleaning operation is finished (SC24).

According to the second variation, similar to the first variation, the conveyor motor 102 is rotated in the forward direction only when there is a high possibility that the media tray 71 will hit against the object. That is, the driving of the conveyor motor 102 in the forward direction can be minimized and the interruptions of the cleaning operation can be minimized.

A control procedure of a media tray discharging process according to a third variation will be described with reference to FIGS. 12A and 12B.

Figure 12A:
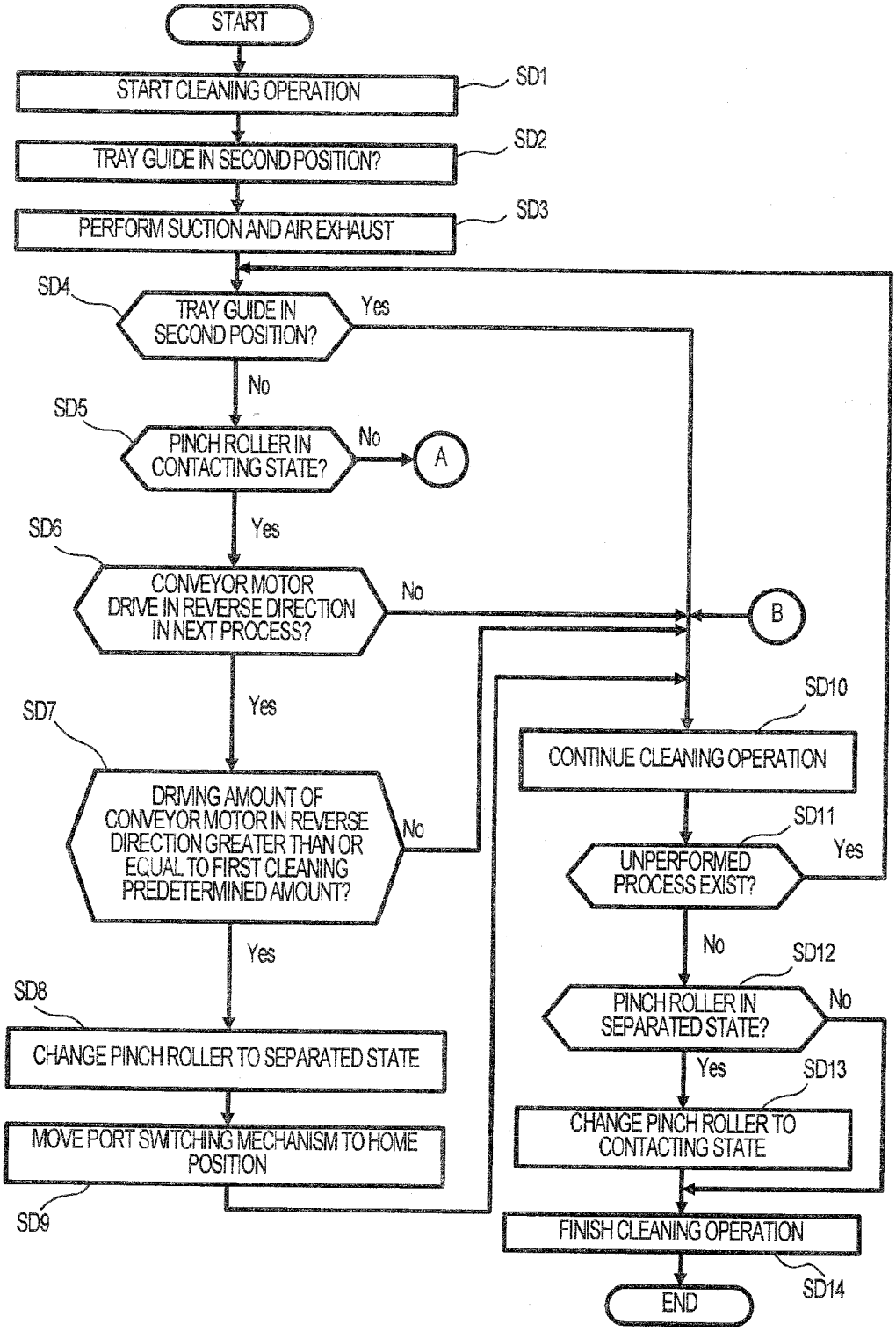
FIG. 12A is a control flowchart for explaining a media tray discharging process in a third variation according to one or more aspects of the invention.

The controller 130 may control the sheet feed motor 101 to change the pinch roller 61 of the first roller pair 58 from the contacting state to the separated state on the condition that the position sensor 77 has detected that the tray guide 76 is not in the second position and the driving amount of the conveyor motor 102 in the reverse direction in the cleaning operation procedure is greater than or equal to a first cleaning predetermined amount under the performance of the cleaning operation, as described later in SD7 and SD8 of FIG. 12A.

The controller 130 may rotate the conveyor motor 102 in the forward direction on the condition that the driving amount of the conveyor motor 102 in the reverse direction in the cleaning operation procedure is greater than or equal to a second cleaning predetermined amount under a condition where the sheet sensor 110 has detected the media tray 71, as described later in SD17 to SD19 of FIG. 12B The controller 130 may control the driving amount of the conveyor motor 102 in the forward direction to be equal to a third cleaning predetermined amount on the condition that the driving amount of the conveyor motor 102 in the forward direction in the cleaning operation procedure is smaller than or equal to the third cleaning predetermined amount under a condition where the sheet sensor 110 has detected the media tray 71, as described later in SD22 and SD23 of FIG. 12B.

Figure 12B:
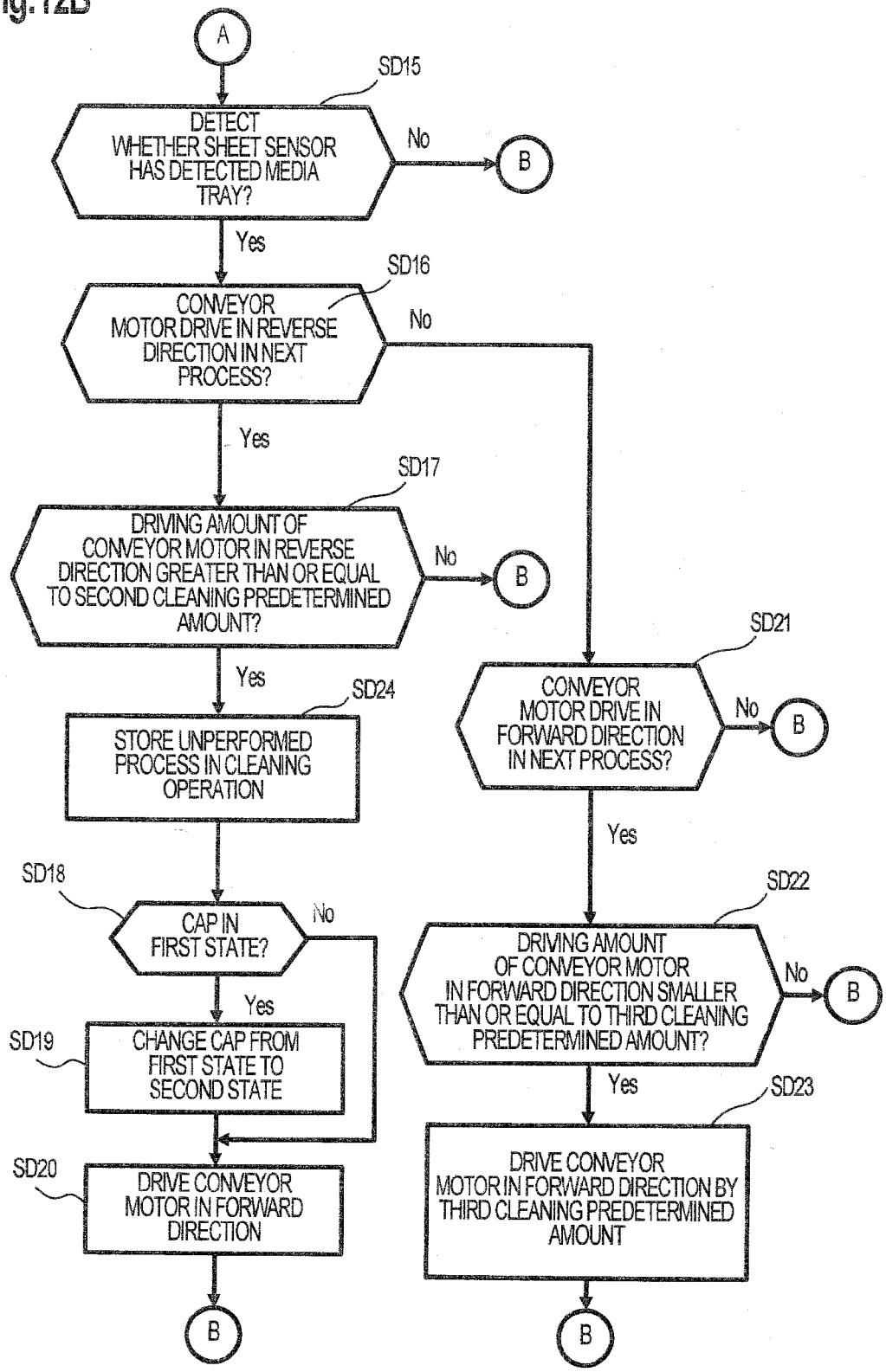
FIG. 12B is a continuation of the control flowchart of FIG. 12A in the third variation according to one or more aspects of the invention.

Some of processing included in the flowcharts of FIGS. 12A and 12B are similar to those included in the flowcharts of FIGS. 9 to 11 and therefore, a description for the similar processing will be omitted.

The processing of SD1, SD2 and SD3 of FIG. 12A are similar to those of SB1, SB2 and SB3 of FIG. 10, respectively. The processing of SD18 to SD20 of FIG. 12B are similar to those of SB12 to SB14 of FIG. 10, respectively.

In the third variation, the pinch roller 61 of the first roller pair 58 may be changed from the contacting state to the separated state upon starting the cleaning operation in SD1. This case will be described below. In a case where an image is recorded on a surface of a recording medium 69, the sheet feed motor 101 is driven to change the pinch roller 61 from the contacting state to the separated state when an instruction to record an image onto the surface of the recording medium 69 is issued through the operating panel 18 while the media tray 71 is placed on the tray guide 76 in the first position, as described above. The tray guide 76 is normally not in the first position when the cleaning operation is performed. If, however, the tray guide 76 is in the first position when an instruction to perform the cleaning operation is issued through the operating panel 18, the sheet feed motor 101 is driven to change the pinch roller 61 from the contacting state to the separated state.

That is, in a case where the tray guide 76 is not in the second position at the time of starting the cleaning operation in SD1, the pinch roller 61 is changed from the contacting state to the separated state. In a case where the tray guide 76 is in the second position at the time of starting the cleaning operation in SD1, the pinch roller 61 is maintained in the contacting state.

When the controller 130 determines that the tray guide 76 is in the second position (SD4:YES) after performing SD1 to SD3, the cleaning operation is continued (SD10).

When determining that the tray guide 76 is not in the second position (SD4:NO), the controller 130 determines whether the pinch roller 61 is in the contacting state or in the separated state (SD5). A sensor for detecting the state of the pinch roller 61 is disposed near the pinch roller 61, whereby the controller 130 can make the determination based on an input signal from the sensor. The controller 130 may store information about the current state of the pinch roller 61 in the RAM 133 and make the determination based on the stored information when the controller 130 drives the sheet feed motor 101 to change the state of the pinch roller 61.

When determining that the pinch roller 61 is in the separated state (SD5:NO), the controller 130 performs processing of SD15 and the subsequent steps (See FIG. 12B). When determining that the pinch roller 61 is in the contacting state (SD5:YES), the controller 130 determines the rotational direction of the conveyor motor 102 in the next process in accordance with the cleaning operation procedure (SD6). That is, the controller 130 determines whether the conveyor motor 102 is to be driven in the reverse direction in the next process.

When the controller 130 determines that the conveyor motor 102 is not to be driven in the reverse direction (SD6:NO), the cleaning operation is continued (SD10). When determining that the conveyor motor 102 is to be driven in the reverse direction (SD6:YES), the controller 130 determines whether the driving amount of the conveyor motor 102 in the reverse direction is greater than or equal to the first cleaning predetermined amount based on the pulse signal from the photodetector of the rotary encoder 122 (SD7).

The first cleaning predetermined amount is the driving amount of the conveyor motor 102 that is required for conveying the media tray 71 in the second direction 6 for the distance A shown in FIG. 2. That is, the first cleaning predetermined amount is a driving amount of the conveyor motor 102 that is required for conveying the media tray 71 from the second roller pair 59 to the first roller pair 58.

When the driving amount of the conveyor motor 102 in the reverse direction is smaller than the first cleaning predetermined amount (SD7:NO), the cleaning operation is continued (SD10). When the driving amount of the conveyor motor 102 in the reverse direction is greater than or equal to the first cleaning predetermined amount (SD7:YES), the controller 130 drives the sheet feed motor 101 to change the pinch roller 61 from the contacting state to the separated state (SD8). By doing so, the media tray 71 being conveyed in the second direction 6 by the reverse rotation of the conveyor motor 102. As a result, the media tray 71 can be conveyed upstream from the first roller pair 58 in the first direction 5. After SD8, the controller 130 drives the switching member 92 of the port switching mechanism 121 to move the port switching mechanism 121 to its home position (SD9). Then, the cleaning operation is continued (SD10).

When determining that the pinch roller 61 is in the separated state in SD5 (SD5:NO), the controller 130 determines whether the sheet sensor 110 has detected the media tray 71 based on an input signal from the photosensor 111 (SD15).

When the sheet sensor 110 has not yet detected the media tray 71 (SD15:NO), the cleaning operation is continued (SD10) (See FIG. 12A). When the sheet sensor 110 has detected the media tray 71 (SD15:YES), the controller 130 determines the rotational direction of the conveyor motor 102 in the next process in accordance with the cleaning operation procedure (SD16 and SD21). That is, the controller 130 determines whether, in the next process, the conveyor motor 102 is to be driven in the forward direction or in the reverse direction, or is not to be driven (the process in which the conveyor motor 102 is not driven, e.g., the changing of the state of the cap 46, is to be performed).

When the conveyor motor 102 is not to be driven in the reverse direction in the next process (SD16:NO), the controller 130 determines whether the conveyor motor 102 is to be driven in the forward direction or the process in which the conveyor motor 102 is not driven is to be performed in the next process (SD21). When the conveyor motor 102 is not to be driven in the forward direction in the next process (SD21:NO), the cleaning operation is continued (SD10 of FIG. 12). When the conveyor motor 102 is to be driven in the forward direction in the next process (SD21:YES), the controller 130 determines whether the driving amount of the conveyor motor 102 in the forward direction in the next process is greater than or equal to the third cleaning predetermined amount based on the pulse signal from the photosensor of the rotary encoder 122 (SD22).

The third cleaning predetermined amount is the driving amount of the conveyor motor 102 that is required for conveying the media tray 71 in the first direction 5 from a detecting point of the sheet sensor 110. The third cleaning predetermined amount is, for example, a driving amount of the conveyor motor 102 in the forward direction required for conveying the media tray 71 from the detecting point to the downstream of the second roller 59 in the first direction 5. More specifically, the third cleaning predetermined amount is a driving amount of the conveyor motor 102 that is required for conveying the media tray 71 in the first direction 5 for at least the distance C shown in FIG. 2.

When the driving amount of the conveyor motor 102 in the forward direction in the next process is greater than the third cleaning predetermined amount (SD22:NO), the cleaning operation is continued (SD10) (See FIG. 12). When the driving amount of the conveyor motor 102 in the forward direction in the next process is smaller than or equal to the third cleaning predetermined amount (SD22:YES), the controller 130 drives the conveyor motor 102 by the third cleaning predetermined amount but not the driving amount of the conveyor motor 102 in the forward direction in the next process (SD23). That is, the driving amount of the conveyor motor 102 in the forward direction in the next process is changed to the third cleaning predetermined amount and then the cleaning operation is continued (SD10) (See FIG. 12A).

When the conveyor motor 102 is to be driven in the reverse direction in the next process in SD16 (SD16:YES), the controller 130 determines whether the driving amount of the conveyor motor 102 in the reverse direction in the next process is greater than or equal to the second cleaning predetermined amount based on the pulse signal from the photosensor of the rotary encoder 122 (SD17).

The second cleaning predetermined amount is the driving amount of the conveyor motor 102 that is required for conveying the media tray 71 in the second direction 6 from the detecting point of the sheet sensor 110 to an object against which the leading edge of the media tray 71 may hit. The object may be, for example, the frame of the multifunction device 10 disposed at a position that the media tray 71 may pass, the rear wall 16 (See FIG. 8) of the multifunction device 10 that does not have the rear opening 87, the outer guide member 22 (a portion shown by a dashed line in FIG. 2) if the second path 65B is not provided, and a wall of a room in which the multifunction device 10 is installed (more specifically, a room wall facing the rear wall 16 of the multifunction device 10).

As shown in FIG. 2, in a case where the object is the rear wall 16 of the multifunction device 10 or the room wall, the second cleaning predetermined amount is the driving amount of the conveyor motor 102 that is required for conveying the media tray 71 in the second direction 6 for a distance D1. In a case where the object is the outer guide member 22, the second cleaning predetermined amount is the driving amount of the conveyor motor 102 that is required for conveying the media tray 71 in the second direction 6 for a distance D2.

When the driving amount of the conveyor motor 102 in the reverse direction in the next process is smaller than the second cleaning predetermined amount (SD17:NO), the cleaning operation is continued (SD10) (See FIG. 12). When the amount of the conveyor motor 102 in the reverse direction in the next process is greater than or equal to the second cleaning predetermined amount (SD17:YES), the controller 130 stores, in the RAM 133, information about an unperformed process in the cleaning operation procedure based on the cleaning execution program (SD24). The controller 130 performs the processing of SD18 to SD20 and then continues the cleaning operation (SD10) (See FIG. 12A).

Processing of SD4 to SD10, and SD15 to SD24 are repeated until all processes of the cleaning operation have been performed (SD11). When the pinch roller 61 is in the separated state at the time when all of the first to the twelfth processes have been performed (SD12:YES), the controller 130 changes the pinch roller 61 from the separated state to the contacting state (SD13) and finishes the cleaning operation (SD14). When the pinch roller 61 is in the contacting state (SD12:NO), the controller 130 maintains the pinch roller 61 in the contacting state and finishes the cleaning operation (SD14).

As described above, when the sheet sensor 110 has detected the media tray 71 in SD15 (SD15:YES), the controller 130 performs the processing of SD20 after the processing of SD16 to SD19. The controller 130 may perform the processing of SD20 without performing the processing of SD16 to SD19. That is, the controller 130 may rotate the conveyor motor 102 in the forward direction on the condition that the sheet sensor 110 has detected the media tray 71 under the performance of the cleaning operation.

In a case where the position sensor 77 detects that the tray guide 76 is not in the second position under the performance of the cleaning operation, the media tray 71 may be supported by the tray guide 76 such that the tray guide 76 allows the media tray 71 to enter the straight path 65. In this case, if the media tray 71 is conveyed in the second direction 6 by the second roller pair 59, the media tray 71 is drawn into the inside of the multifunction device 10. When the conveying distance of the media tray 71 by the second roller pair 59 is long, for example, when the driving amount of the conveyor motor 102 is greater than or equal to the first cleaning predetermined amount, there is a high possibility that the media tray 71 will hit against the first roller pair 58 comprising the first conveyor roller 60 and the pinch roller 61 which are in contact with each other. According to the third variation, in the case described above, the controller 130 controls the sheet feed motor 101 to separate the pinch roller 61 from the first conveyor roller 60. Thus, the media tray 71 can be prevented from hitting against the first roller pair 58.

In a case where an object exists downstream of the sheet sensor 110 in the second direction 6, the media tray 71 may hit against the object if the media tray being conveyed in the second direction 6 is further conveyed in the second direction 6 after detected by the sheet sensor 110. According to the third variation, the controller 130 rotates the conveyor motor 102 in the forward direction when the sheet sensor 110 detects the media tray 71. By doing so, the media tray 71 is conveyed in the first direction 5 by the first roller pair 58 and the second roller pair 59. Accordingly, the media tray 71 can be prevented from being drawn behind the first roller pair 58 in the first direction 5 and the media tray 71 can be prevented from hitting against an object.

In the third variation, similar to the first variation, the driving of the conveyor motor 102 in the forward direction by the controller 130 during the cleaning operation can be minimized as described below. When the conveyor motor 102 is rotated in the reverse direction under a condition where the sheet sensor 110 has detected the media tray 71, the media tray 71 is conveyed in the second direction 6. However, when the driving amount of the conveyor motor 102 in the reverse direction in the next process is, for example, smaller than the second cleaning predetermined amount, the media tray 71 is to be conveyed in the second direction 6 for a short distance, so that there is a less possibility that the media tray 71 will hit against the object existing on the side in the direction that the media tray 71 proceeds. Then, the driving amount of the conveyor motor 102 in the reverse direction finishes is, for example, greater than or equal to the second cleaning predetermined amount, the media tray 71 is to be conveyed in the second direction 6 for a long distance, so that there is a high possibility that the media tray 71 will hit against the object. According to the third variation, the conveyor motor 102 is driven in the forward direction only when the driving amount of the conveyor motor 102 in the reverse direction in the next process is greater than or equal to the second cleaning predetermined amount, i.e., when there is a high possibility that the media tray 71 will hit against the object. That is, the driving of the conveyor motor 102 in the forward direction, which causes the interruptions of the cleaning operation in progress, can be minimized.

When the conveyor motor 102 is driven in the forward direction under a condition that the sheet sensor 110 has detected the media tray 71, the media tray 71 is conveyed in the first direction 5. However, when the driving amount of the conveyor motor 102 in the forward direction in the next process is, for example, smaller than or equal to the third cleaning predetermined amount, the media 71 is to be conveyed in the first direction 5 for a short distance. Then, the driving of the conveyor motor 102 in the forward direction may be stopped although the media tray 71 does not reach its discharge position. After that, if the conveyor motor 102 is driven in the reverse direction in this state, the media tray 71 is conveyed in the second direction 6. According to the third variation, the controller 130 controls the driving amount of the conveyor motor 102 in the forward direction to be the third cleaning predetermined amount. By doing so, the media tray 71 can be surely discharged from the multifunction device 10.

Although in the flowcharts of FIGS. 9 to 12B, the determination as to whether the tray guide 76 is in the second position is not performed between the first process and the sixth process in the cleaning operation procedure, such the determination may be performed between the first process and the sixth process.

For example, in the flowchart of FIG. 9, when it is determined that the tray guide 71 is not in the second position at the time between the first process and the seventh process, the processing of SA21 and the subsequent steps are performed. In the flowchart of FIG. 10, when it is determined that the tray guide 71 is not in the second position at the time between the first process and the sixth process, the processing of SB21 and the subsequent steps are performed. In the flowchart of FIG. 11, when it is determined that the tray guide 71 is not in the second position at the time between the first process and the sixth process, the processing of SC16 and the subsequent steps are performed. In the flowchart of FIG. 12A, when it is determined that the tray guide 71 is not in the second position at the time between the first process and the sixth process, the processing of SD5 and the subsequent steps are performed.

In the flowcharts of FIGS. 9 to 12, the determination as to whether the tray guide 76 is in the second position is performed at the predetermined timings. However, the controller 130 may refer to input signals from the position sensor 77 at all times. By doing so, the determination can be also performed at a timing other than the predetermined timings.

For example, in the flowchart of FIG. 9, when it is determined that the tray guide 71 is not in the second position at the time from the start of the first process and before the start of the eighth process, the processing of SA21 and the subsequent steps are performed. When it is determined that the tray guide 71 is not in the second position at the time from the start of the eighth process and before the start of the ninth process, the processing of SA23 and the subsequent steps are performed. When it is determined that the tray guide 71 is not in the second position at the time from the start of the ninth process and before the start of the eleventh process, the processing of SA24 and the subsequent steps are performed. When it is determined that the tray guide 71 is not in the second position at the time of the start of the eleventh process or after there on, the processing of SA23 and the subsequent steps are performed.

For example, in the flowchart of FIG. 10, when it is determined that the tray guide 71 is not in the second position at the time from the start of the first process and before the start of the seventh process, the processing of SB21 and the subsequent steps are performed. When it is determined that the tray guide 71 is not in the second position at the time of the start of the seventh process or after there on, the processing of SB8 and the subsequent steps are performed.

For example, in the flowchart of FIG. 11, when it is determined that the tray guide 71 is not in the second position at the time from the start of the first process and before the start of the seventh process, the processing of SC16 and the subsequent steps are performed. When it is determined that the tray guide 71 is not in the second position at the time of the start of the seventh process or after there on, the processing of SC8 and the subsequent steps are performed.

For example, in the flowchart of FIG. 12A, when it is determined that the tray guide 71 is not in the second position at the time from the start of the cleaning operation to the end of the cleaning operation, the processing of SD5 and the subsequent steps are performed.

What is claimed is:

1. An inkjet recording device comprising:

a tray configured to receive a recording medium;

a tray guide movable between:

a first position, in which the tray guide supports the tray such that the tray guide allows the tray to enter a conveying path, configured for passage of the tray; and a second position, which is a different position from the first position with respect to a direction intersecting a direction that the conveying path extends;

a first sensor configured to output a first signal indicative of the position of the tray guide;

a recording portion configured to record an image on the recording medium;

a cleaning mechanism configured to clean the recording portion;

a first conveyor portion disposed downstream of the recording portion and upstream of the tray guide as viewed from rear to front direction and configured to convey the tray along the conveying path in a first direction from the recording portion to the tray guide and in a second direction that is reverse to the first direction;

a first drive source configured to rotate in a forward direction of rotation and a reverse direction of rotation;

a power transmitting portion configured to:

transmit a force generated by the forward direction of rotation of the first drive source to both the cleaning mechanism and the first conveyor portion as driving force to convey the tray in the first direction and drive the cleaning mechanism; and transmit a force generated by the reverse direction of rotation of the first drive source to both the cleaning mechanism and the first conveyor portion as driving force to convey the tray in the second direction and drive the cleaning mechanism; and a control section configured to:

control a cleaning operation of the recording portion based on a predetermined procedure, the predetermined procedure including a plurality of processes, said control section driving the first drive source in accordance with each of the plurality of processes to control the cleaning mechanism by rotating the first drive source in either the forward direction of rotation, the reverse direction of rotation or no rotation; and drive the first drive source in the forward direction of rotation using a first predetermined amount of drive to convey the tray to a downstream side of the first conveyor portion as viewed from the rear to front direction and where the tray is not in contact with the first conveyor portion if the control section determined that, from the first signal output from the first sensor, the first sensor has detected that the tray guide is not in the second position under the cleaning operation.

2. The inkjet recording device according to claim 1, wherein if the control section determined that, from the first signal output from the first sensor, the first sensor detects that the tray guide is not in the second position prior to performing any of the plurality of processes, the control section drives the first drive source in the forward direction of rotation using the first predetermined amount of drive to convey the tray to the downstream side of the first conveyor portion as viewed from the rear to front direction and where the tray is not in contact with the first conveyor portion.

3. The inkjet recording device according to claim 2, further comprising:

a second sensor configured to output a second signal indicative of a driving amount of the first drive source, and wherein if the control section determined that, from the signal output from the first sensor, the first sensor detects that the tray guide is not in the second position after performing at least one of the plurality of processes, the control section determines a direction of rotation for a current process of the plurality of processes and wherein if the direction of rotation is the reverse direction, the control section drives the first drive source in the forward direction of rotation using the first predetermined amount of drive to convey the tray to the downstream side of the first conveyor portion as viewed from the rear to front direction and where the tray is not in contact with the first conveyor portion if the detected driving amount for the current process is greater than or equal to a second predetermined amount.

4. The inkjet recording device according to claim 2, further comprising:

a second sensor configured to output a second signal indicative of a driving amount of the first drive source;

a storage section configured to store a cumulative driving amount of the first drive source, the cumulative driving amount of the first drive source being sum of driving amount in the reverse direction of rotation, and wherein if the control section determined that, from the signal output from the first sensor, the first sensor detects that the tray guide is not in the second position after performing at least one of the plurality of processes, the control section determines a direction of rotation for a current process of the plurality of processes and wherein if the direction of rotation is the reverse direction, the control section drives the first drive source in the forward direction of rotation using the first predetermined amount of drive to convey the tray to the downstream side of the first conveyor portion as viewed from the rear to front direction and where the tray is not in contact with the first conveyor portion if the cumulative driving amount is greater than or equal to a third predetermined amount.

5. The inkjet recording device according to claim 4, wherein the control section is configured to add the detected driving amount of the current process to the cumulative driving amount of the first drive source stored in the storage section if the cumulative driving amount is smaller than the third predetermined amount.

6. The inkjet recording device according to claim 4, wherein the control section is configured to reset the cumulative driving amount to zero.

7. The inkjet recording device according to claim 3, wherein the second predetermined amount is a driving amount of the first drive source that is required for conveying the tray in the second direction from the first conveyor portion to an object against which a leading edge of the tray may hit.

8. The inkjet recording device according to claim 3, wherein the second predetermined amount is a driving amount of the first drive source that is required for conveying the tray from the first conveyor portion to a second conveyor portion disposed upstream of the first conveyor portion as viewed from rear to front direction.

9. The inkjet recording device according to claim 3, wherein the second predetermined amount is a driving amount of the first drive source that is required for conveying the tray from the first conveyor portion to an outer guide member of the conveying path.

10. The inkjet recording device according to claim 3, wherein the second predetermined amount is a driving amount of the first drive source that is required for conveying the tray from the first conveyor portion to a rear wall of the inkjet recording device.

11. The inkjet recording device according to claim 4, wherein the third predetermined amount is a driving amount of the first drive source that is required for conveying the tray in the second direction from the first conveyor portion to an object against which a leading edge of the tray may hit.

12. The inkjet recording device according to claim 3, further comprising:

a cap movable between a first state and a second state a third sensor configured to output a third signal indicative of a state of the cap, wherein the control section configured to drive the first drive source in the forward direction of rotation if the control section determined that, from the third signal output from the third sensor, the third sensor has detected that the cap is in the second state.

13. The inkjet recording device according to claim 1, further comprising:

a storage section configured to store an unperformed process including at least one of the plurality of processes when the control section determined that, from the first signal output from the first sensor, the first sensor has detected that the tray guide is not in the second position under the cleaning operation, wherein the control section is configured to perform the unperformed process stored in the storage section after the control section drives the first drive source in the forward direction of rotation using the first predetermined amount of drive.

14. The inkjet recording device according to claim 13, wherein the control section is configured to perform the unperformed process stored in the storage section if the control section determined that, from the first signal output from the first sensor, the first sensor has detected that the tray guide is in the second position after the control section drives the first drive source in the forward direction of rotation using the first predetermined amount of drive.

* * * * *